US008286751B2

(12) United States Patent
Furuya et al.

(10) Patent No.: US 8,286,751 B2
(45) Date of Patent: Oct. 16, 2012

(54) MUFFLING DEVICE

(75) Inventors: Hiroyuki Furuya, Kawasaki (JP); Atsushi Yamaguchi, Kawasaki (JP); Kazuhiro Nitta, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/894,374

(22) Filed: Sep. 30, 2010

(65) Prior Publication Data

US 2011/0079462 A1 Apr. 7, 2011

(30) Foreign Application Priority Data

Oct. 2, 2009 (JP) ..... 2009-230747

(51) Int. Cl.
*G10K 11/00* (2006.01)
*E04F 17/04* (2006.01)

(52) U.S. Cl. ..... 181/224; 181/241; 181/277

(58) Field of Classification Search ..... 181/224, 181/225, 226, 241, 277, 227, 228, 278, 279, 181/280

See application file for complete search history.

(56) References Cited

U.S. PATENT DOCUMENTS

| | | | | |
|---|---|---|---|---|
| 3,253,676 | A * | 5/1966 | Bottum | 181/241 |
| 4,276,954 | A * | 7/1981 | Romano | 181/224 |
| 4,513,841 | A * | 4/1985 | Shimoji et al. | 181/252 |
| 5,930,371 | A * | 7/1999 | Cheng et al. | 381/71.5 |
| 7,258,196 | B2 * | 8/2007 | Radatus et al. | 181/224 |
| 7,328,586 | B2 * | 2/2008 | Gau et al. | 62/158 |
| 7,581,619 | B1 * | 9/2009 | Storm | 181/225 |
| 2005/0161280 | A1 * | 7/2005 | Furuya | 181/225 |
| 2005/0252716 | A1 * | 11/2005 | Moenssen et al. | 181/277 |
| 2007/0125592 | A1 * | 6/2007 | Michell et al. | 181/206 |

FOREIGN PATENT DOCUMENTS

| | | |
|---|---|---|
| JP | 06-058151 | 3/1994 |
| JP | 2005-030308 | 2/2005 |
| WO | WO 2008126253 A1 * | 10/2008 |

* cited by examiner

*Primary Examiner* — Jeremy Luks
(74) *Attorney, Agent, or Firm* — Squire Sanders (US) LLP

(57) ABSTRACT

A muffling device has a muffling piece that is placed in an airflow path and muffles sound caused by airflow, and a drive unit that performs one of rotation and movement of the muffling piece.

9 Claims, 23 Drawing Sheets

RESULTS OF FREQUENCY ANALYSIS SOUND SOURCE : WHITE NOISE

IMPACT OF ROTATION OF MUFFLING PIECE ON PRESSURE LOSS

IMPACT OF OPENING RATIO OF DUCT ON PRESSURE LOSS

MUFFLING DEVICE

CROSS-REFERENCE TO RELATED APPLICATION

This application is based upon and claims the benefit of priority from the prior Japanese Patent Application No. 2009-230747 filed on Oct. 2, 2009, the entire contents of which are incorporated herein by reference.

FIELD

The embodiments discussed herein are related to a muffling device or noise reduction device.

BACKGROUND

Conventionally, a muffling piece has been employed to reduce noise in various places. For example, a muffling piece is sometimes placed in every position where noise reduction is needed such as an air-conditioning duct, an electric appliance, or a building. In general, the larger the surface area of the muffling piece is, the higher probability there is that the noise may hit the muffling piece. Therefore, when measures to increase the size of the surface area of the muffling piece are taken, such as installation of an additional muffling piece or an enlargement of the muffling piece, noise reduction performance may be improved.

Such muffling pieces are discussed in Japanese Laid-open Patent Publication No. 06-58151 and Japanese Laid-open Patent Publication No. 2005-30308, for example.

As described above, when the size of the surface area of the muffling piece is increased, the noise reduction performance may be improved. However, the measures such as the installation of the additional muffling piece may undesirably cause an increase in ventilation resistance, pressure loss, or the like in some places. Also, the noise may be undesirably increased because of the increase in ventilation resistance or pressure loss, possibly causing a decrease in the noise reduction performance. In addition, the installation of the additional muffling piece may also cause an increase in the cost of muffling equipment. The muffling pieces discussed in both the Japanese Laid-open Patent Publication No. 06-58151 and the Japanese Laid-open Patent Publication No. 2005-30308 muffle sounds corresponding to frequencies of the noise.

SUMMARY

In accordance with an embodiment, a muffling device has a muffling piece that is placed in an airflow path and muffles sound caused by airflow, and a drive unit that performs one of rotation and movement of the muffling piece.

DESCRIPTION OF EMBODIMENTS

Figure 1A:
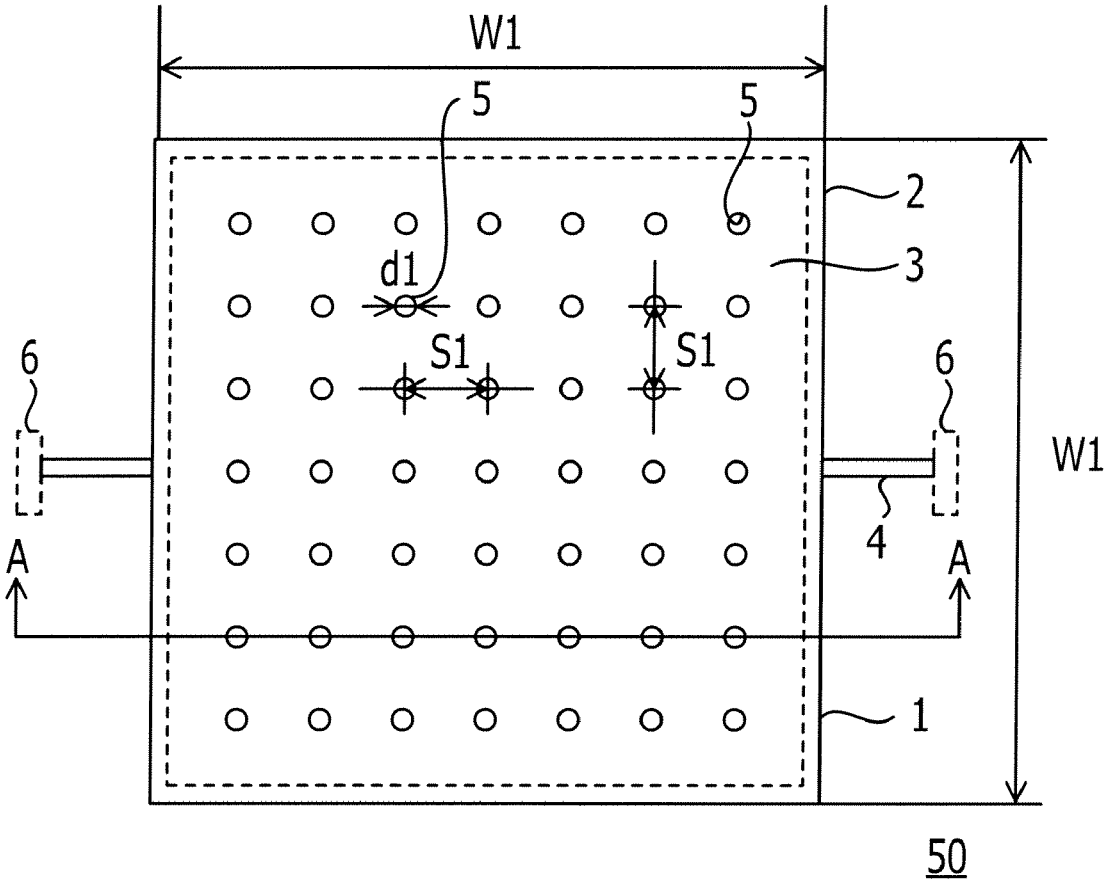
FIG. 1A is a plain view of a muffling device according to a first embodiment.

Embodiments are discussed below with reference to attached drawings. Note, however, that dimensions, proportions, and the like of respective parts may not be illustrated so that the dimensions, the proportions, and the like of respective parts correctly reflect the actual muffling device in the drawings. Moreover, there may be cases where details of the respective parts are omitted in the drawings.

Figure 1B:
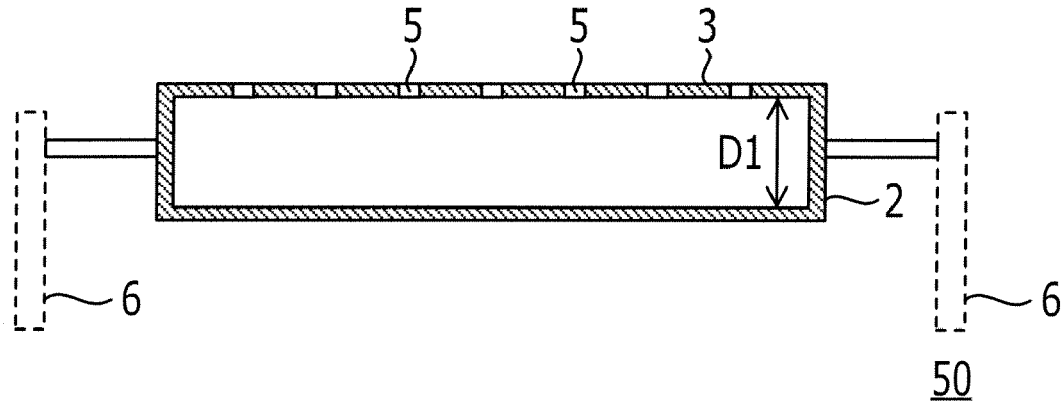
FIG. 1B is an A-A sectional view of the muffling device in FIG. 1A.

FIG. 1A is a plain view of a muffling device 50 according to a first embodiment, and FIG. 1B is an A-A sectional view of the muffling device 50 in FIG. 1A. The muffling device 50 includes a muffling piece 1. The muffling piece 1 can include a body section 2 that is box-shaped, and a top plate 3 provided for the body section 2. In this example, the top plate 3 includes two or more holes 5, and the interior of the muffling piece 1 is hollow. The muffling piece 1 includes a rotation shaft 4 that may be rotatably attached to a support post 6. The muffling piece 1 may be rotated by swirling flow or the like when the muffling piece 1 is placed on the support post 6. The muffling piece 1 may be rotated by a drive unit such as a motor that is attached to the rotation shaft 4.

The muffling piece 1 is described below. The material of the muffling piece 1 may be a steel plate with a thickness, for example, of 1 mm. The muffling piece 1 is substantially square in shape, and a length W1 of the side of the muffling piece 1 can be, for example, about 76 mm. A distance S1 between holes is about 10 mm. A diameter d1 of the hole 5 is about 2.3 mm. The top plate 3 includes seven rows by seven columns of the holes 5, 49 holes in total. The thickness of the hollow space, a depth D1 in the muffling piece 1, is about 13 mm.

Such a muffling piece 1 of the muffling device 50 is an illustrative example only. Hence, dimensions of respective parts may not be limited to the muffling piece 1 illustrated in FIG. 1. Such a muffling piece 1 is placed in a position where noise reduction is desired. The muffling piece 1 may be placed in an airflow path such as the inside of a duct, for example. The muffling piece 1 may also be attached to an electric appliance.

The surface of the top plate 3 of such a muffling piece 1 may be the main surface that the sound to be muffled hits. The rotation of the muffling piece 1 displaces the surface of the top plate 3. The displacement of the surface of the top plate 3 causes an increase in the amount of sound to be muffled because the probability of the sound hitting the surface of the top plate 3 is increased.

The surface of the top plate 3 is the main surface that the sound to be muffled hits, in addition, the side surfaces and the bottom surface of the body section 2 of the muffling piece 1 are also equivalent to the surface that the sound to be muffled hits. The rotation of the muffling piece 1 also displaces the side surface and the bottom surface as well. As a result, the amount of sound to be muffled increases depending on the increase in muffling performance because the probability of the sound hitting the surfaces is also increased.

Thus, any muffling piece may be employed as long as the surface of the muffling piece is displaced and obtains the muffling performance. The muffling piece may be a box-shaped body; for example, a muffling piece where the holes 5 on the top plate 3 are removed. Also, the muffling piece may be made up of a member including a material that has noise absorbing performance, such as a noise absorbing sponge. Also, the muffling device discussed herein may employ any known muffling piece. For example, a so-called Helmholtz-type muffling piece may be employed.

When the muffling piece 1 includes the holes 5 as illustrated in FIG. 1, the sound to be muffled enters the inside of the muffling piece 1 from the holes 5 and the energy of the sound is absorbed into the muffling piece 1 at a frequency where resonance is induced within the muffling piece 1. As a result, the sound may be reduced. As the probability of the sound hitting the muffling piece 1 is increased because of the rotation of the muffling piece 1, the muffling performance may be further improved.

The muffling piece illustrated in 1 FIG. 1 rotates using the rotation shaft 4, however, the muffling piece 1 may perform a desired movement in order to displace the surface of the muffling piece. For example, the muffling piece may rotate, move horizontally, move vertically, or move diagonally. In addition, the muffling piece may perform a movement that is a combination of any of these above-described movements as appropriate.

Figure 2:
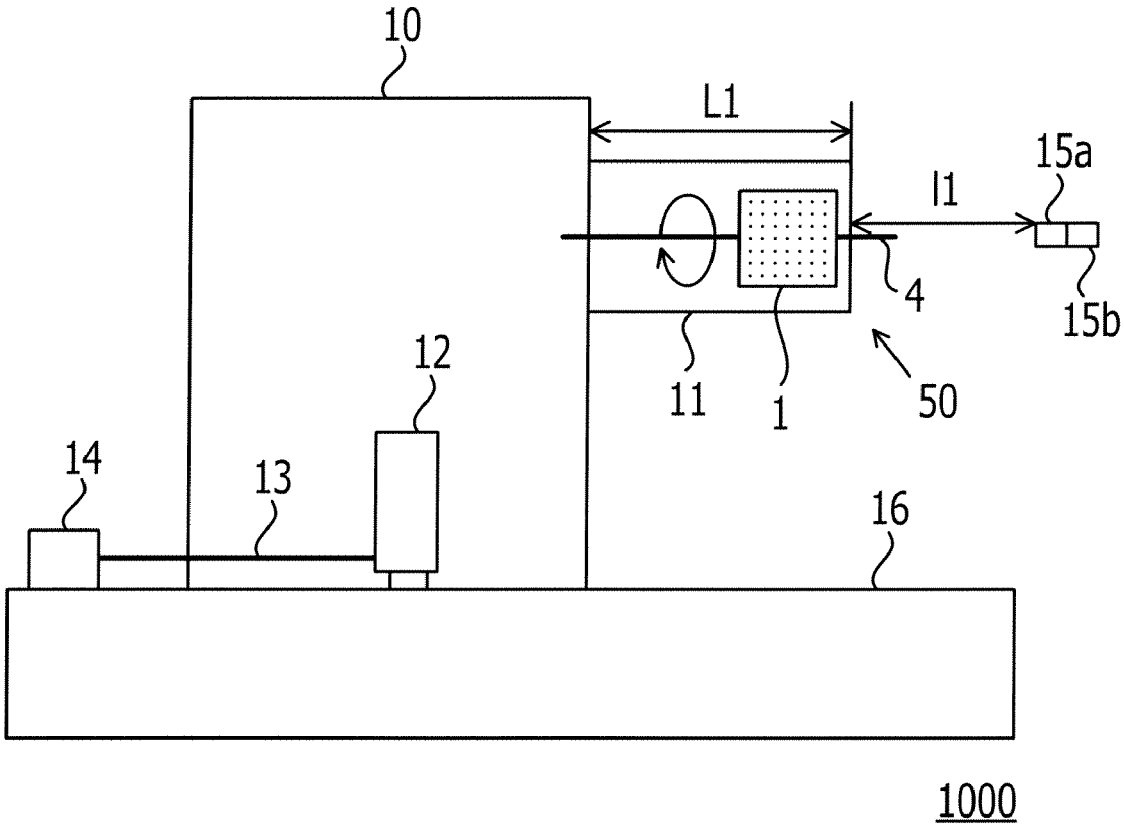
FIG. 2 is a schematic view of a muffling test apparatus.
Figure 7:
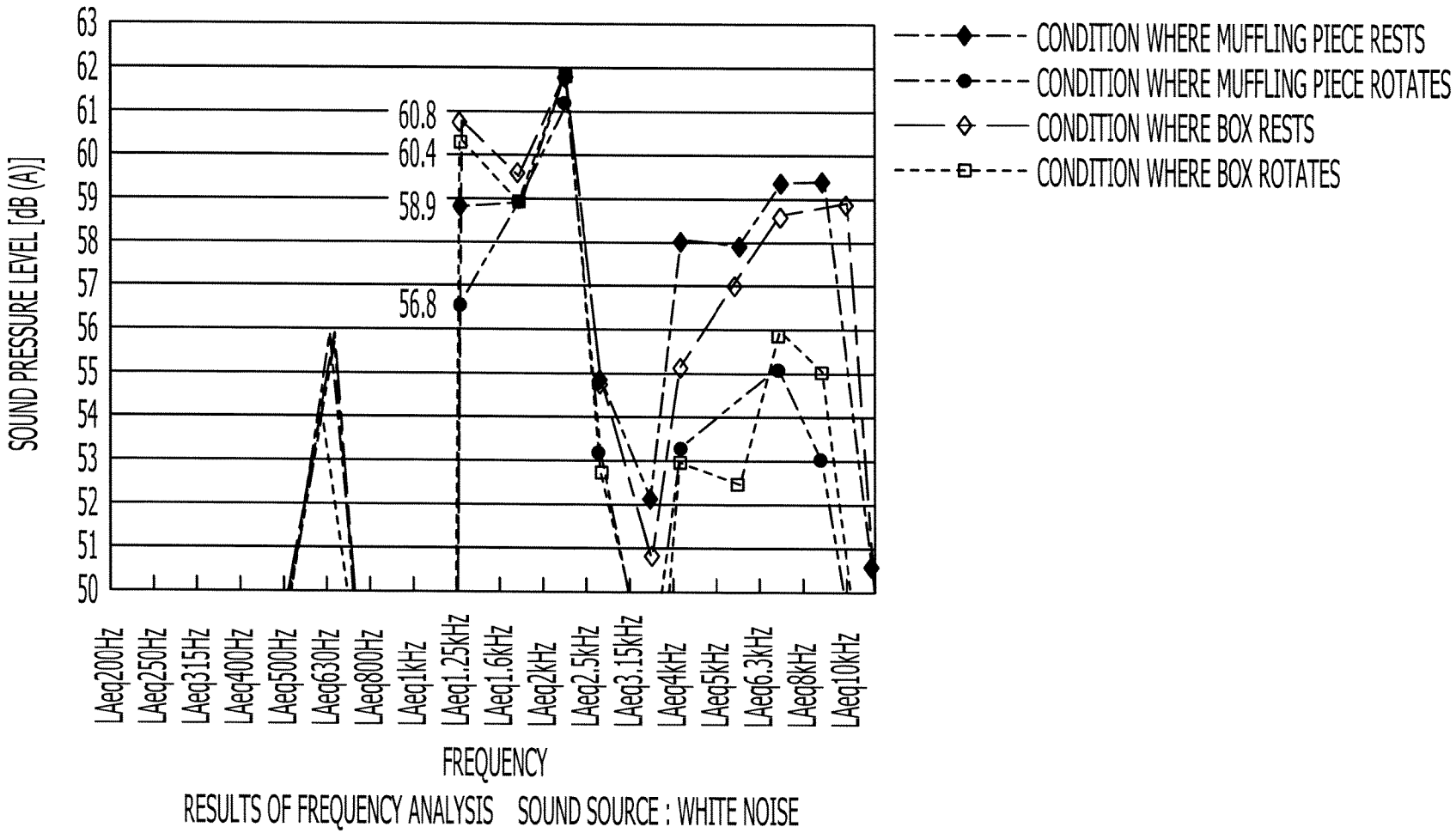
FIG. 7 is a graph illustrating the results of the muffling test.

A muffling test of the muffling device 50 is described below. FIG. 2 is a schematic view of a muffling test apparatus 1000. The muffling test apparatus 1000 is placed on a test table 16 in a measurement room. The measurement room in this example is an acoustic test room (semi-anechoic room type). The muffling test apparatus 1000 includes a shielded box 10 that is made of aluminum and a duct 11. A speaker 12 is arranged inside the shielded box 10. The speaker 12, model number RP-SPF01 made by Panasonic Corporation, was used. The speaker 12 is coupled to a personal computer 14 through a cable 13. In addition, the muffling test apparatus 1000 includes a microphone 15*a*. The microphone 15*a* is placed in a position where the distance I1 from the microphone 15*a* to the end section of the duct 11 is about 180 mm. The microphone 15*a* is coupled to a noise meter 15*b*. The microphone 15*a*, model number 4189 made by Bruel & Kjaer A/S, was used. The noise meter 15*b*, model number 2250 made by Bruel & Kjaer A/S, was used. White noise was used as a sound source. In addition, the sound pressure level over a wide range of frequencies was measured in order to conduct verification of the muffling performance corresponding to each of the frequencies as illustrated in FIG. 7.

Figure 3A:
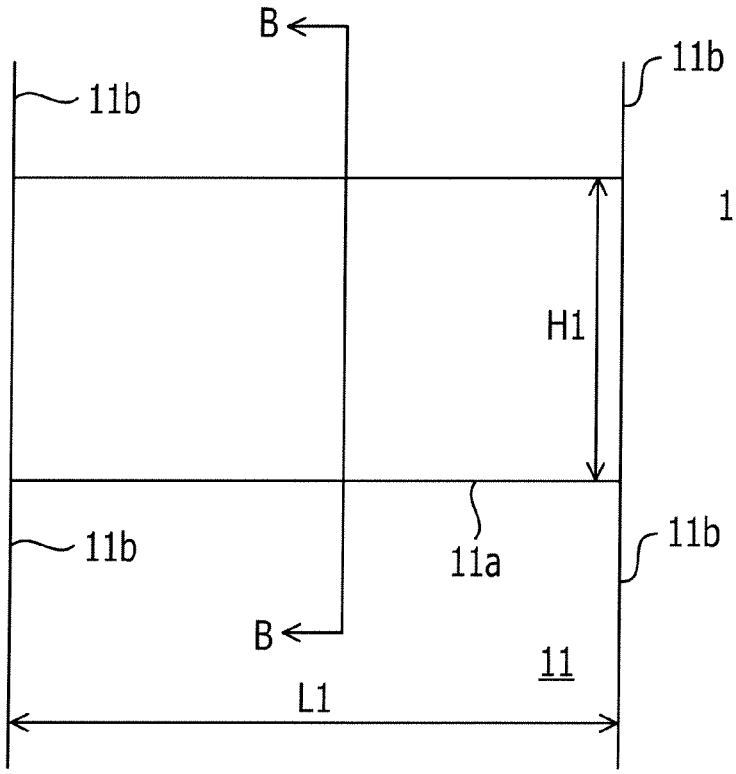
FIG. 3A is a side view of a duct in which the muffling device is placed in the muffling test apparatus in FIG. 2.
Figure 3B:
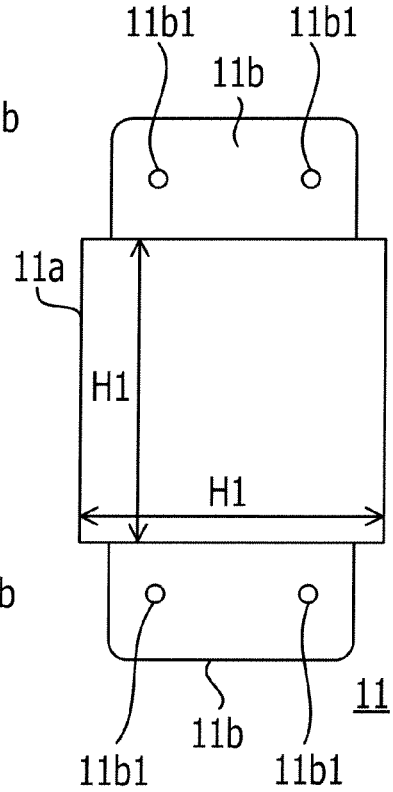
FIG. 3B is a B-B sectional view of the duct in FIG. 3A.
Figure 4:
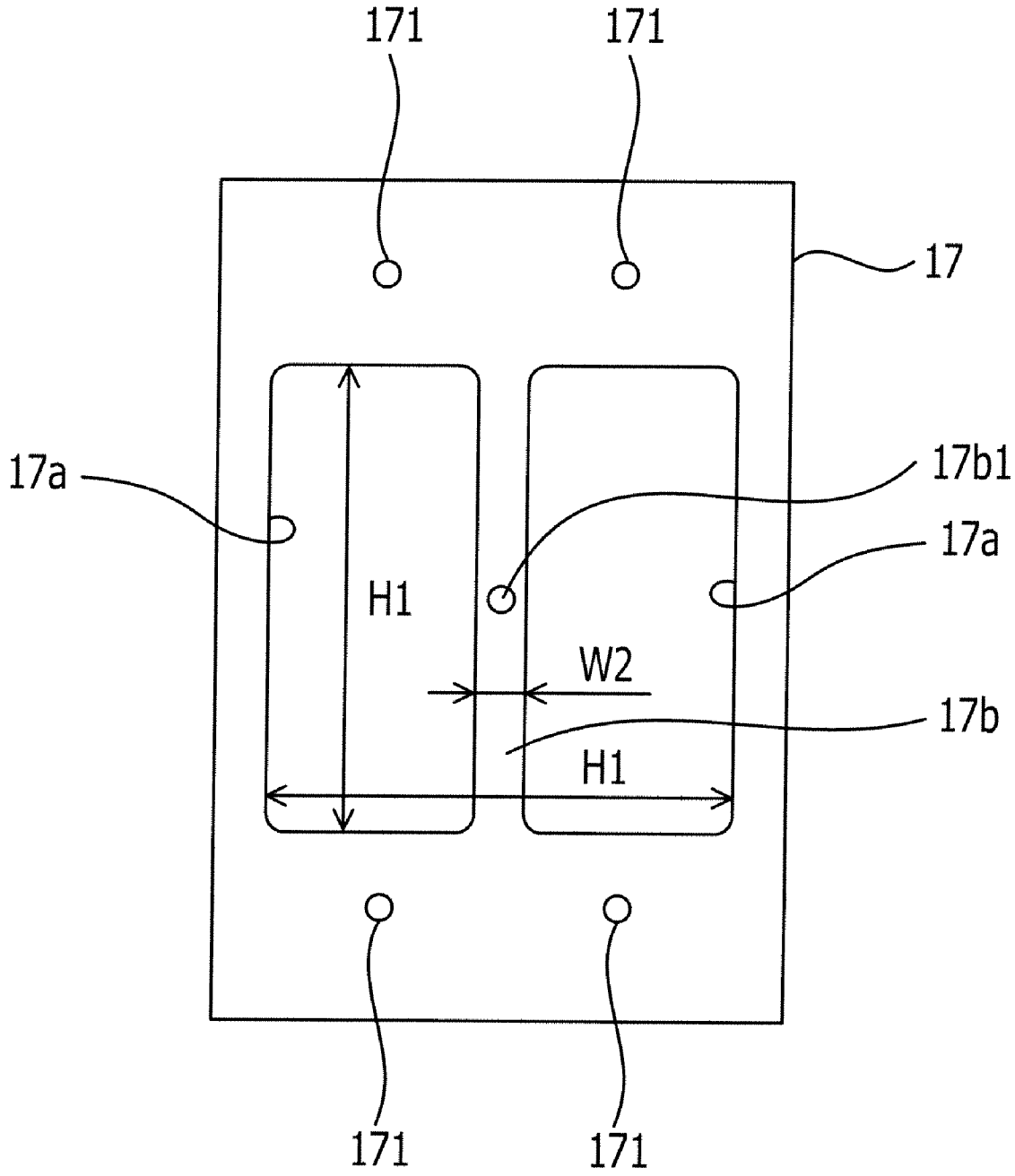
FIG. 4 is a front view of an end plate placed at each of the end sections of the duct in FIG. 3A and FIG. 3B.

The duct 11 is attached to an opening section (not illustrated) provided for the shielded box 10. The muffling device 50 is placed in the duct 11. FIG. 3A is a side view of the duct 11. FIG. 3B is a B-B sectional view of the duct 11 in FIG. 3A. The material of the duct 11 may be an aluminum plate with a thickness of about 0.8 mm. The duct 11 includes a body 11*a* and a flange section 11*b* placed at each of the end sections of the body 11*a* respectively. The flange section 11*b* includes a mounting hole 11*b*1. An entire length L1 of the duct 11 may be set to 200 mm. The duct 11 includes an opening section that is substantially square in shape, and a length H1 of the side of the opening section is about 100 mm.

A side end surface plate 17 is attached to each of the end sections of the duct 11, respectively. The side end surface plate 17 is made of a material similar to the material of the duct 11. The side end surface plate 17 includes two opening sections 17*a*. A pillar section 17*b* that has a width W2 is provided between the opening sections 17*a*. A shaft hole 17*b*1 is provided for the pillar section 17*b*. The rotation shaft 4 provided for the muffling piece 1 is mounted in the shaft hole 17*b*1. An extended rotation shaft 4 may be prepared for the test. The side end surface plate 17 includes a mounting hole 171. The side end surface plate 17 is attached to each of the end sections of the duct 11 respectively by using the mounting hole 171 provided for the side end surface plate 17, and the mounting hole 11*b*1 provided for the flange section 11*b*.

When a power source such as a motor is used for the rotation of the muffling piece 1, noise from the power source makes it difficult to properly evaluate the muffling performance against sound coming from the speaker 12. Thus, in the muffling test apparatus 1000, the muffling piece 1 was rotated manually with the rotation shaft 4. The number of rotations may range from 200 to 350 RPM.

The results of the muffling test using the aforementioned muffling test apparatus 1000 are described below with reference to FIG. 5 to FIG. 7. In the muffling test, the sound pressure level was measured under four conditions and the results of the muffling test were compared. The four conditions where the muffling test was conducted are as follows:

(1) A condition where a box rests;

(2) A condition where a box rotates;

(3) A condition where the muffling piece rests; and (4) A condition where the muffling piece rotates.

"A box" refers to a box-shaped body, that is, a muffling piece where the holes 5 on the top plate 3 are sealed. Such a box-shaped body may be employed as the muffling piece in the muffling device discussed herein.

Figure 5:
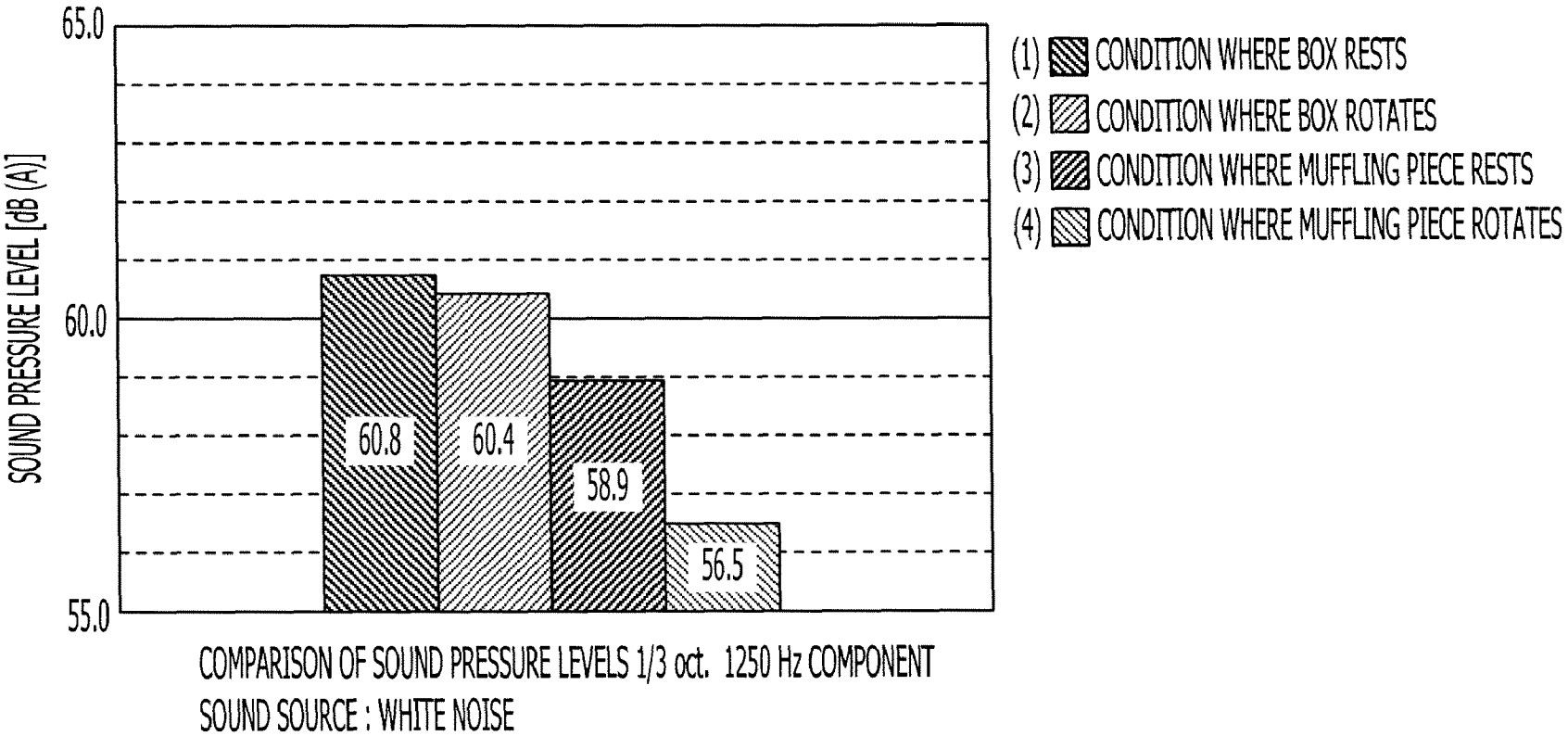
FIG. 5 is a graph illustrating the results of a muffling test.

FIG. 5 is a graph that illustrates a measurement value of the sound pressure level. FIG. 6 is a graph that illustrates the muffling performance (the amount of sound to be muffled) of the muffling piece 1 and the muffling performance (the amount of sound to be muffled) by the rotation.

As illustrated in FIG. 5, the sound pressure level in A condition where a box rests (1) was 60.8 dB (A), the sound pressure level in A condition where a box rotates (2) was 60.4 dB (A), the sound pressure level in A condition where the muffling piece rests (3) was 58.9 dB (A), and the sound pressure level in A condition where the muffling piece rotates (4) was 56.5 dB (A).

Figure 6:
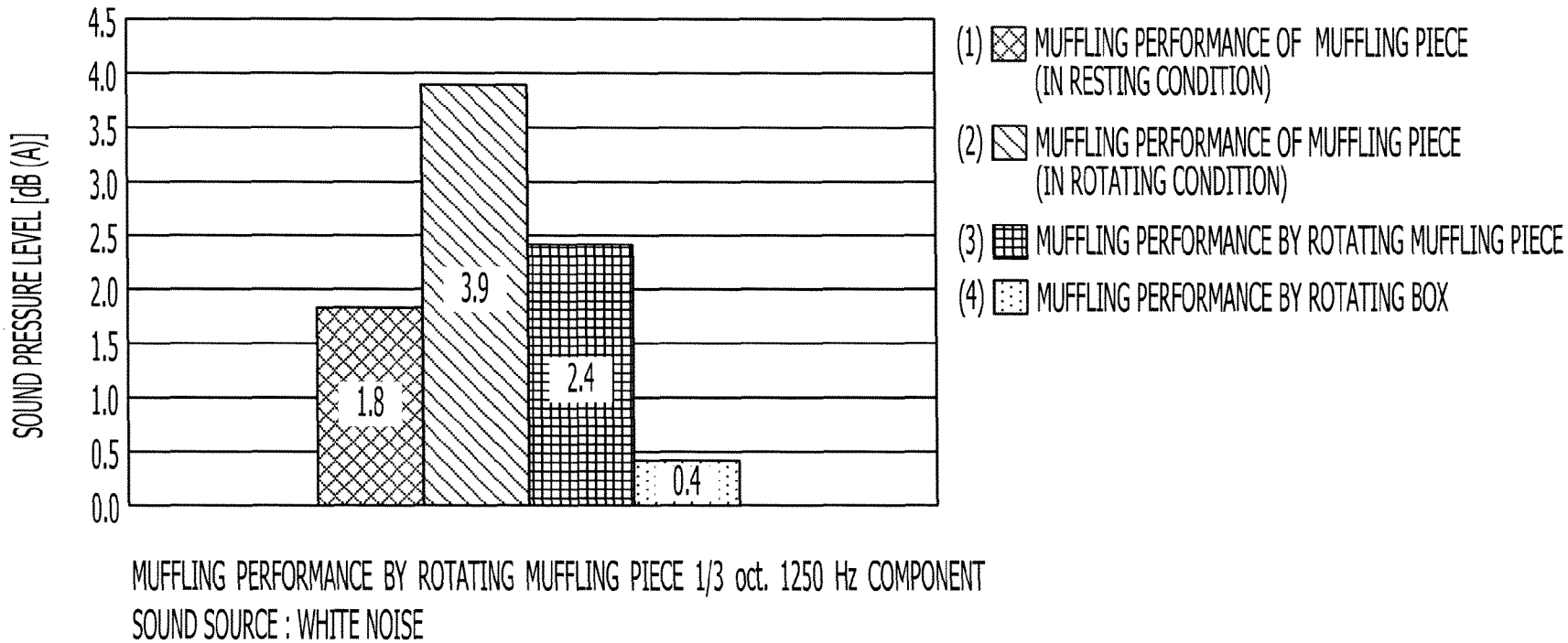
FIG. 6 is a graph illustrating the results of the muffling test.

The muffling performance of the muffling piece 1 and the muffling performance by the rotation are checked with reference to FIG. 6.

The muffling performance of the muffling piece (1) in FIG. 6 is calculated from a condition where a box rests" and a condition where the muffling piece rests (1) in FIG. 5. That is, (60.8-58.9) dB (A)=1.8 dB (A) is calculated when the resultant values of (1) and (3) in FIG. 5 are compared. As both of (1) and (3) are compared in the resting state, the value of 1.8 dB (A) may result from the muffling performance of the muffling piece 1, that is, muffling performance obtained by providing the holes 5 for the top plate 3 of the muffling piece 1.

The muffling performance of the muffling piece (2) in FIG. 6 is calculated from a condition where a box rotates (2) and a condition where the muffling piece rotates (4) in FIG. 5. That is, (60.4-56.5) dB (A)=3.9 dB (A) is calculated when the resultant values of (2) and (4) in FIG. 5 are compared. As both (2) and (4) are compared in the rotating state, the value of 3.9 dB (A) may result from the muffling performance of the muffling piece 1, that is, muffling performance obtained by providing the holes 5 for the top plate 3 of the muffling piece 1.

The muffling performance by rotation of the muffling piece (3) in FIG. 6 is calculated from a condition where the muffling piece rests (3) and a condition where the muffling piece rotates (4) in FIG. 5. That is, (58.9-56.5) dB (A)=2.4 dB (A) is calculated when the resultant values of (3) and (4) in FIG. 5 are compared. As (3) and (4) are compared in different states of the muffling piece, the value of 2.4 dB (A) may result from the muffling performance that is obtained by rotating the muffling piece 1.

The muffling performance by rotation of a box (4) in FIG. 6 is calculated from a condition where a box rests (1) and a condition where a box rotates (2) in FIG. 5. That is, (60.8-60.4) dB (A)=0.4 dB (A) is calculated when the resultant values of (1) and (2) in FIG. 5 are compared. As (1) and (2) are compared in different states of the box, the value of 0.4 dB (A) may result from the muffling performance that is obtained by rotating the box.

The resultant value of the muffling performance by rotation of a box (4) in FIG. 6 indicates that merely the box-shaped body may obtain the muffling performance by rotating the box.

The resultant value of the muffling performance by rotation of the muffling piece (3) in FIG. 6 indicates that the high muffling performance may be obtained by rotating the muffling piece 1. It is also evident from the result that the value of the muffling performance by rotation of a box is 0.4 dB (A) while the value of the muffling performance by rotation of the muffling piece (3) is 2.4 dB (A).

The high muffling performance obtained by rotating the muffling piece 1 is also evident from the comparison of the muffling performance of the muffling piece (1) and the muffling performance of the muffling piece (2) in FIG. 6. Thus, a high synergy of the muffling performance that is obtained by providing the holes 5 for the top plate 3 and rotating the muffling piece 1 may be exhibited.

Hence, it is found that the muffling performance may be obtained by rotating the box, and that further muffling performance may be obtained by rotating the muffling piece 1.

The results of a frequency analysis are described below with reference to FIG. 7. For example, the results of the sound pressure level at a high frequency that is equal to or more than 2.5 kHz are described below. The condition where the muffling piece 1 rests, which is indicated by a filled diamond (♦) and the condition where the muffling piece 1 rotates, which is indicated by a filled circle (●) are compared at the same frequency. As a result, the sound pressure levels may differ at each of the frequencies and the muffling performance may be obtained. Moreover, the condition where the box rests, which is indicated by an open diamond (◇) and the condition where the box rotates, which is indicated by an open square (□) are compared at the same frequency. As a result, the sound pressure levels may differ at each of the frequencies and the muffling performance may be obtained.

Thus, far better muffling performance can be recognized by rotating the box and muffling piece at the high frequency range than by rotating the box and muffling piece at a lower frequency range (for example, less than or equal to 2 kHz).

As a result, the muffling performance against the sound at the high frequency may be improved by rotating the box and muffling piece.

For example, at a frequency of about 1250 Hz (1.25 kHz), the muffling performance as described with reference to FIG. 5 and FIG. 6 may be obtained, because the muffling piece 1 may be suited to be used at the frequency of about 1250 Hz.

Figure 8:
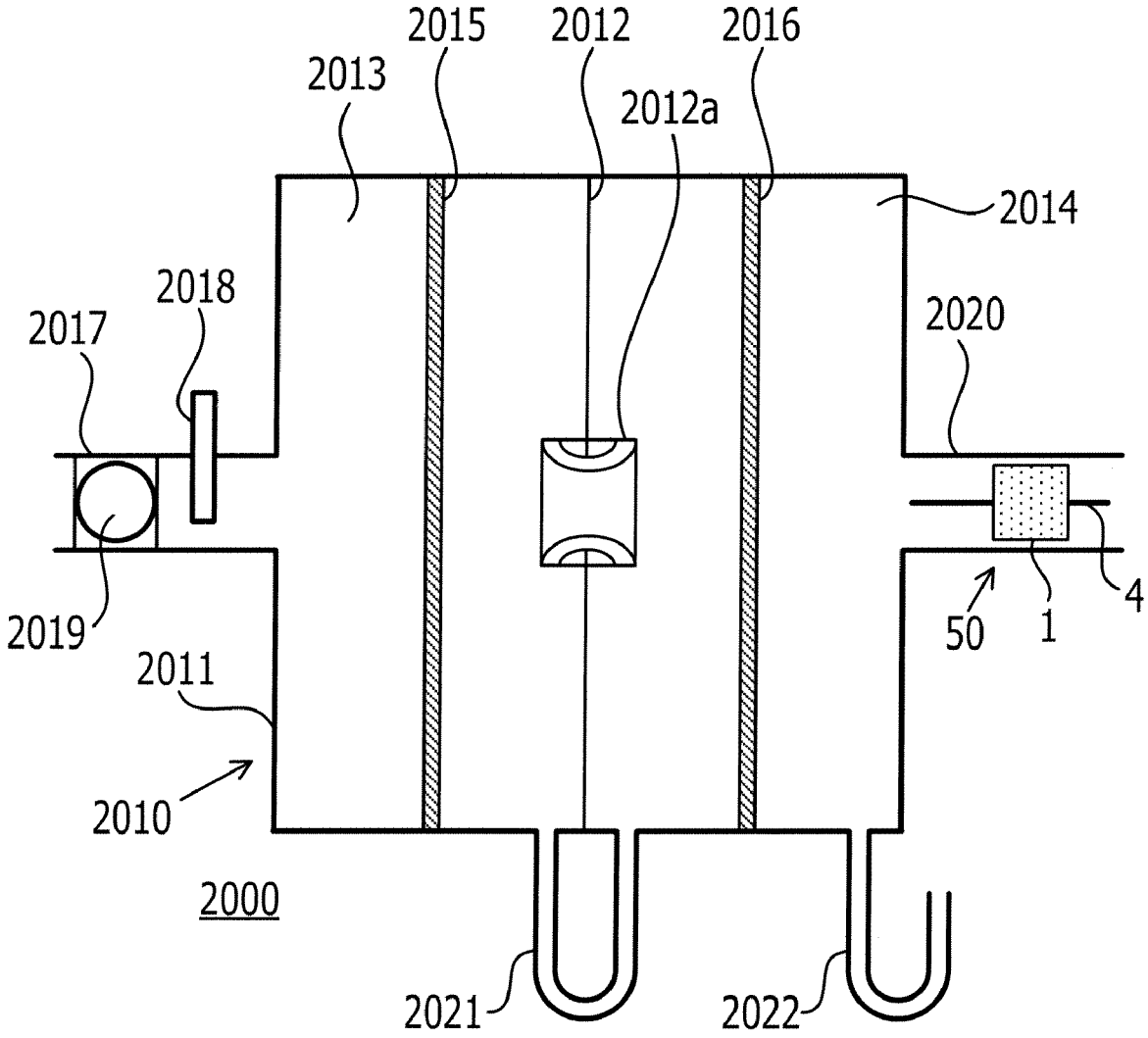
FIG. 8 is a schematic view of a pressure loss test apparatus.

A pressure loss test for the muffling device 50 is described below. The pressure loss test evaluates a pressure loss caused by placing the muffling device 50 in a position where it is desired to muffle sound. FIG. 8 is a schematic view of a pressure loss test apparatus 2000. The pressure loss test apparatus 2000 includes an airflow measurement apparatus 2010. The airflow measurement apparatus 2010 includes a chamber 2011. The chamber 2011 is divided into a first chamber 2013 and a second chamber 2014 by a partition member 2012 that includes a nozzle 2012*a*. A first flow-rectifying lattice 2015 is provided for the inside of the first chamber 2013, and a second flow-rectifying lattice 2016 is provided for the inside of the second chamber 2014. A first duct 2017 is located on a side of the first chamber 2013 in the chamber 2011. A damper 2018 that may go up and down is attached to the first duct 2017. An auxiliary blower 2019 is placed in the first duct 2017. A second duct 2020 similar to the duct 11 in the muffling test apparatus 1000 is located on a side opposite to the first duct 2017. The muffling piece 1 is placed through the rotation shaft 4 in the second duct 2020. The airflow measurement apparatus 2010 includes a first differential-pressure meter 2021, a second differential-pressure meter 2022, and at least one sensor (not illustrated) such as a thermometer and a hygrometer. The sensors are coupled to a personal computer (not illustrated) so that the personal computer collects data.

Three conditions under which the pressure loss test was conducted are as follows:

(1) A condition where the muffling piece rotates and a duct opens 100%;

(2) A condition where the muffling piece rests horizontally and a duct opens 100%;

(3) A condition where the muffling piece rests horizontally and a duct opens 75%; and (4) A condition where the muffling piece rests horizontally and a duct opens 100%, which is the same condition as condition (2).

Under each of the conditions, a change of static pressure [Pa] was measured by changing the amount of airflow that is passed through the duct. The above-described 100% and 75% refer to the opening ratio of the duct 11 using the damper 2018 that may go up and down. In the pressure loss test, the pressure loss that is caused by rotating the muffling piece 1 and the pressure loss that is caused by changing the opening ratio of the duct 11 are compared. The result of a pressure loss test similar to the result of the pressure loss test obtained by reducing the opening ratio of the duct 11 may be obtained by placing two or more muffling pieces or an enlarged muffling piece in the duct 11. The muffling piece 1 may be rotated at approximately 300 rpm.

The results of the muffling test using the aforementioned pressure loss test apparatus 2000 are described below with reference to FIG. 9 and FIG. 10.

Figure 9:
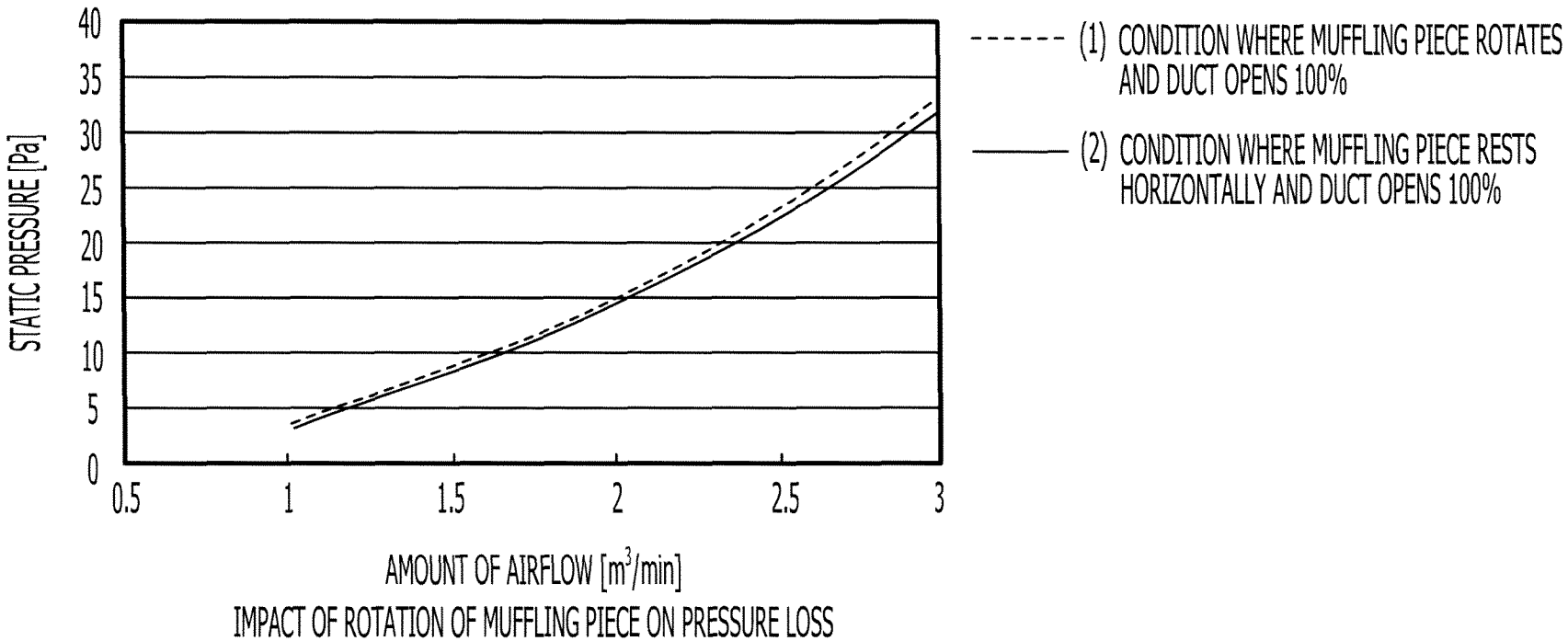
FIG. 9 is a graph illustrating the results of a pressure loss test.
Figure 10:
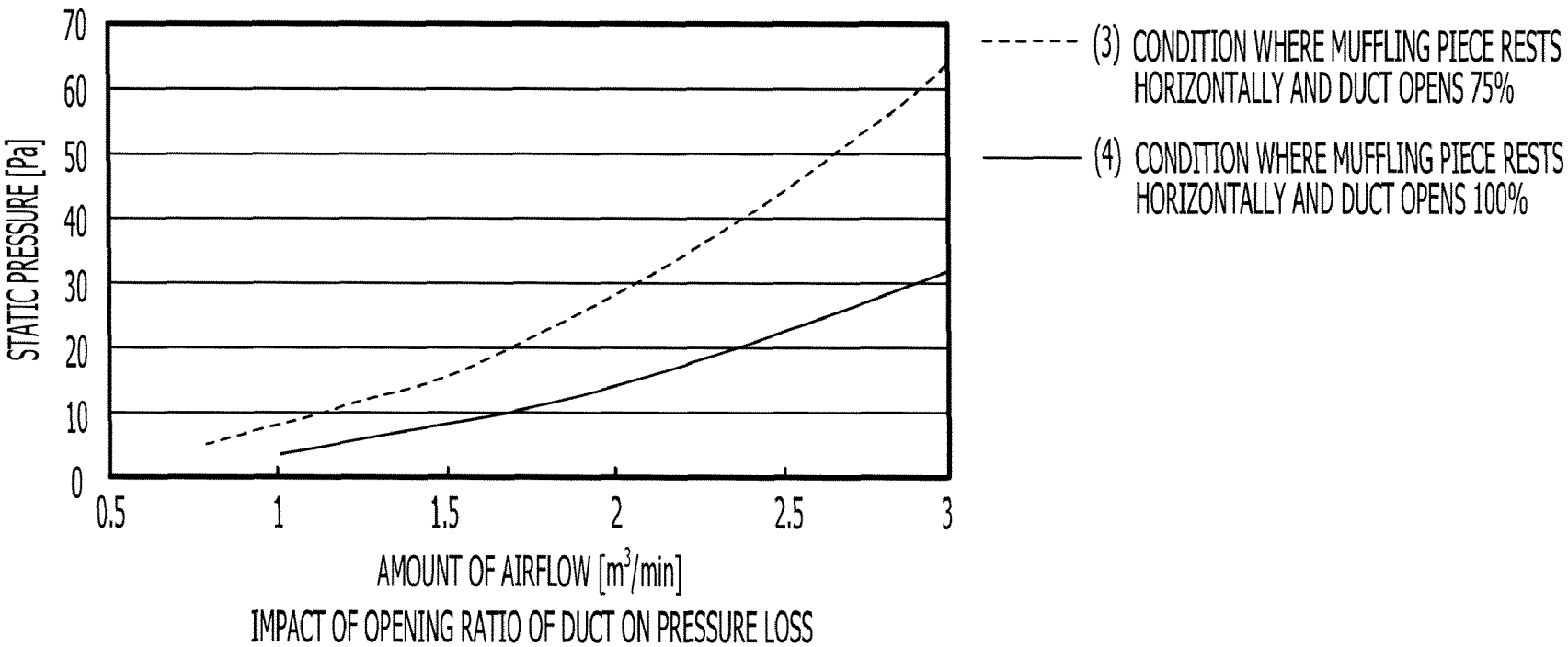
FIG. 10 is a graph illustrating the results of the pressure loss test.

In FIG. 9, the result of a condition where the muffling piece rotates and a duct is 100% open (1) and the result of a condition where the muffling piece rests horizontally and a duct is 100% open (2) are described. In FIG. 10, the result of a condition where the muffling piece rests horizontally and a duct is 75% open (3) and the result of a condition where the muffling piece rests horizontally and a duct is 100% open (4) are described.

The pressure loss may be evaluated by calculating a constant K that is included in an equation, $P=KQ^2$, which indicates pressure loss characteristics, and by comparing the constants K. As the value of the constant K is larger, the pressure loss is greater. The P refers to the static pressure [Pa] and the Q refers to the amount of airflow [$m^3$/min]. The constants K under the respective test conditions of (1) to (4) are calculated from graphs illustrated in FIG. 9 and FIG. 10.

In the case of a condition where the muffling piece rotates and a duct is 100% open, the value of the constant K was 3.831, and in the case of a condition where the muffling piece rests horizontally and a duct is 100% open", the value of the constant K was 3.618 (2). It is found that the pressure loss is merely increased a little, even when the muffling piece 1 is rotated.

In the case of a condition where the muffling piece rests horizontally and a duct opens 75% (3), the value of the constant K was 7.569, and in the case of a condition where the muffling piece rests horizontally and a duct is 100% open (4), which is the same condition as (2), the value of the constant K was 3.618". It is found that the pressure loss is highly increased when the opening ratio of the duct 11 is reduced. Thus, it is probable that the pressure loss may be increased when two or more muffling pieces or the enlarged muffling piece are placed in the duct 11. The placement of two or more muffling pieces or the enlarged muffling piece may cause an increase in the number of fan rotations in order to obtain a desired amount of airflow in a duct, etc., that circulates cold air. The increase in the number of fan rotations may increase noise undesirably.

The rotation of the muffling piece 1 as described in the first embodiment may reduce an increase in pressure loss and may enhance the muffling performance.

Figure 11A:
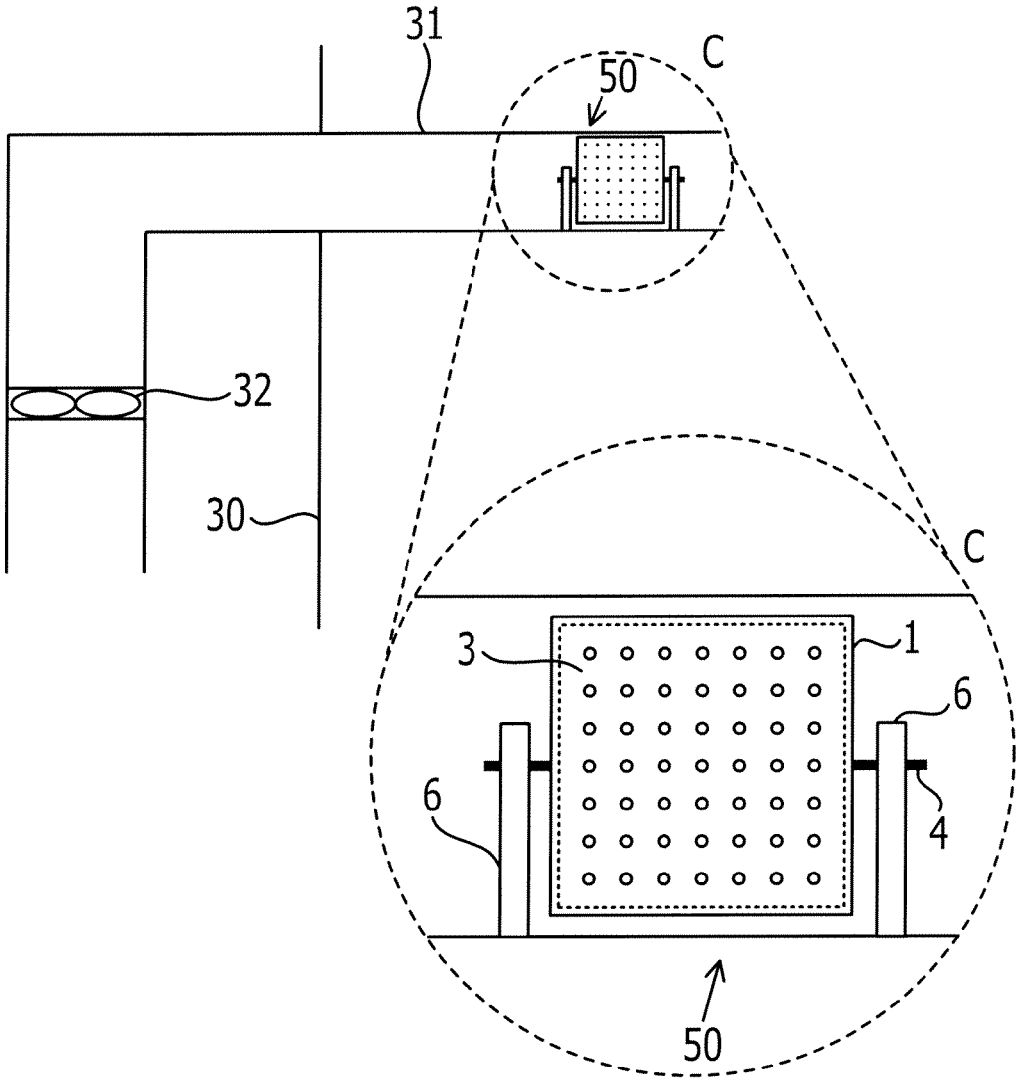
FIG. 11A is a schematic view of the muffling device in FIG. 1 placed in a duct.
Figure 11B:
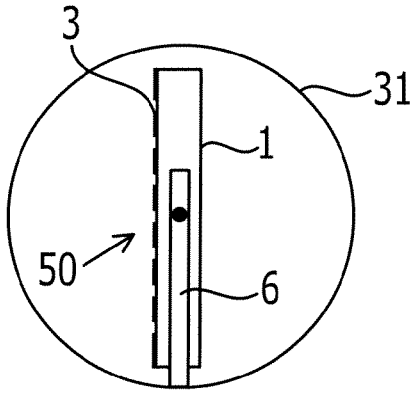
FIG. 11B is a schematic view of the muffling device in FIG. 11A when viewed from the direction of airflow.

A state where the aforementioned muffling device 50 is placed in an air conditioning duct 31 is described below with reference to FIG. 11A and FIG. 11B. FIG. 11A is a schematic view of the muffling device 50 in FIG. 1 placed in the duct 31. FIG. 11B is a schematic view of the muffling device 50 in FIG. 11A when viewed from the direction of airflow.

The muffling device 50 is placed in an air-conditioning duct 31 arranged to bring in air from outside the building 30 to inside the building 30 as illustrated in FIG. 11A. An air-conditioning fan 32 is attached to the air-conditioning duct 31. An airflow path is formed inside the air-conditioning duct 31. The muffling device 50 is placed in the air-conditioning duct 31 so that the top plate 3 is parallel to the airflow direction as the enlarged C section is illustrated in FIG. 11A. The swirling flow is caused by the air-conditioning fan 32. The muffling piece is rotated by the swirling flow. The muffling piece 1 may muffle sound caused by the airflow and reduce the amount of noise that is carried from the air-conditioning fan 32 or the outside of the building 32 to the inside of the building 32 by the placement of the muffling device 50. In addition, the amount of sound that is carried from the inside of the building 32 to the outside of the building 32 may also be reduced. The muffling device 50 may enhance the muffling performance without reducing the cross-sectional area of the air-conditioning duct 31 as much as possible.

The rotation shaft 4 may be rotated by a power source such as the motor, depending on such as the location for the placement of the muffling device 50.

Figure 12:
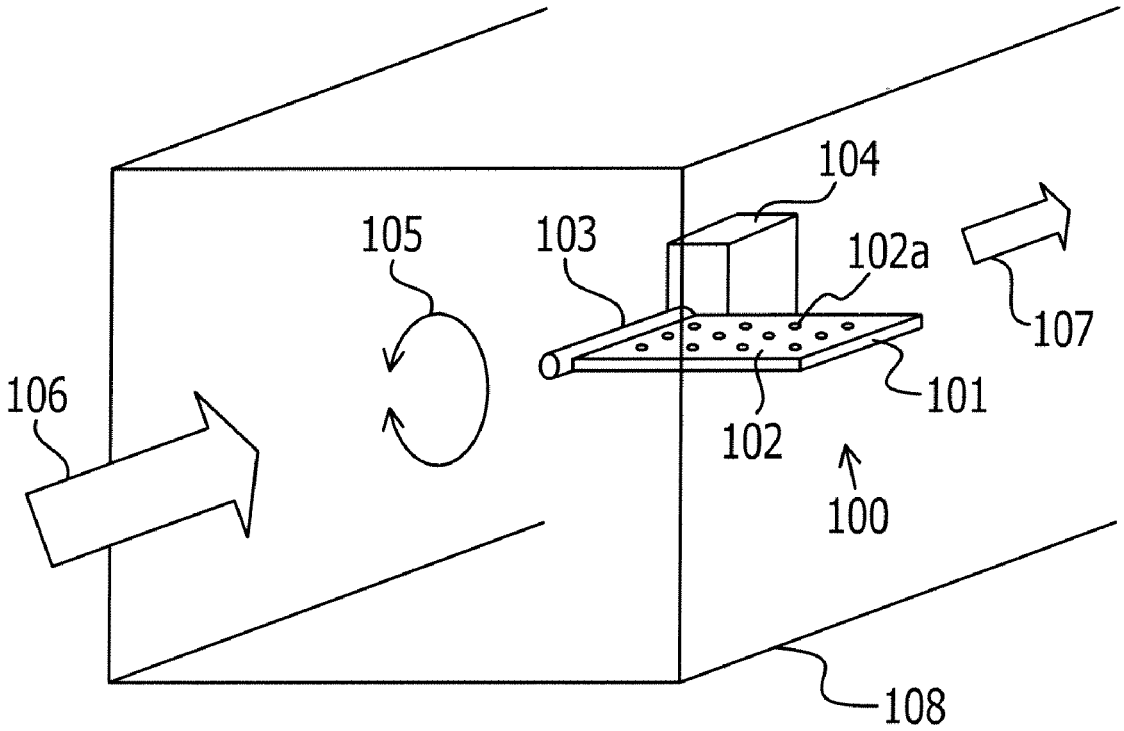
FIG. 12 is a schematic view of a muffling device according to a second embodiment.

FIG. 12 is a schematic view of a muffling device 100 according to a second embodiment. The muffling device 100 illustrated in FIG. 12 includes a muffling piece 101. A top plate 102 provided for the muffling piece 101 includes two or more holes 102*a*. The surface of the top plate 102 may be the main surface that the sound to be muffled hits. A rotation shaft 103 is attached to a side edge of the muffling piece 101 as illustrated in FIG. 12. The rotation shaft 103 is coupled to a motor 104. The motor 104 may be an example of a drive unit that rotates the muffling piece 101. The muffling piece may rotate about the rotation shaft 103 by the motor 104. The position of the rotation shaft 103 in FIG. 12 may be another position, such as a position horizontally through near a center point of the muffling piece 101, for example. In addition, two or more muffling pieces may be attached to the rotation shaft 103 so that the position of the rotation shaft 103 is on each of the side edges of the muffling pieces, or horizontally through near the center point of each of the muffling pieces.

Such a muffling device 100 is placed in a duct 108. The inside of the duct 108 may be an airflow path. In FIG. 12, when the muffling piece 101 rotates as illustrated by arrow 105, noise that has entered the duct 108 as illustrated by arrow 106 is reduced and passes through the duct 108 as illustrated by arrow 107 because of muffling performance of the muffling device 100.

Figure 13:
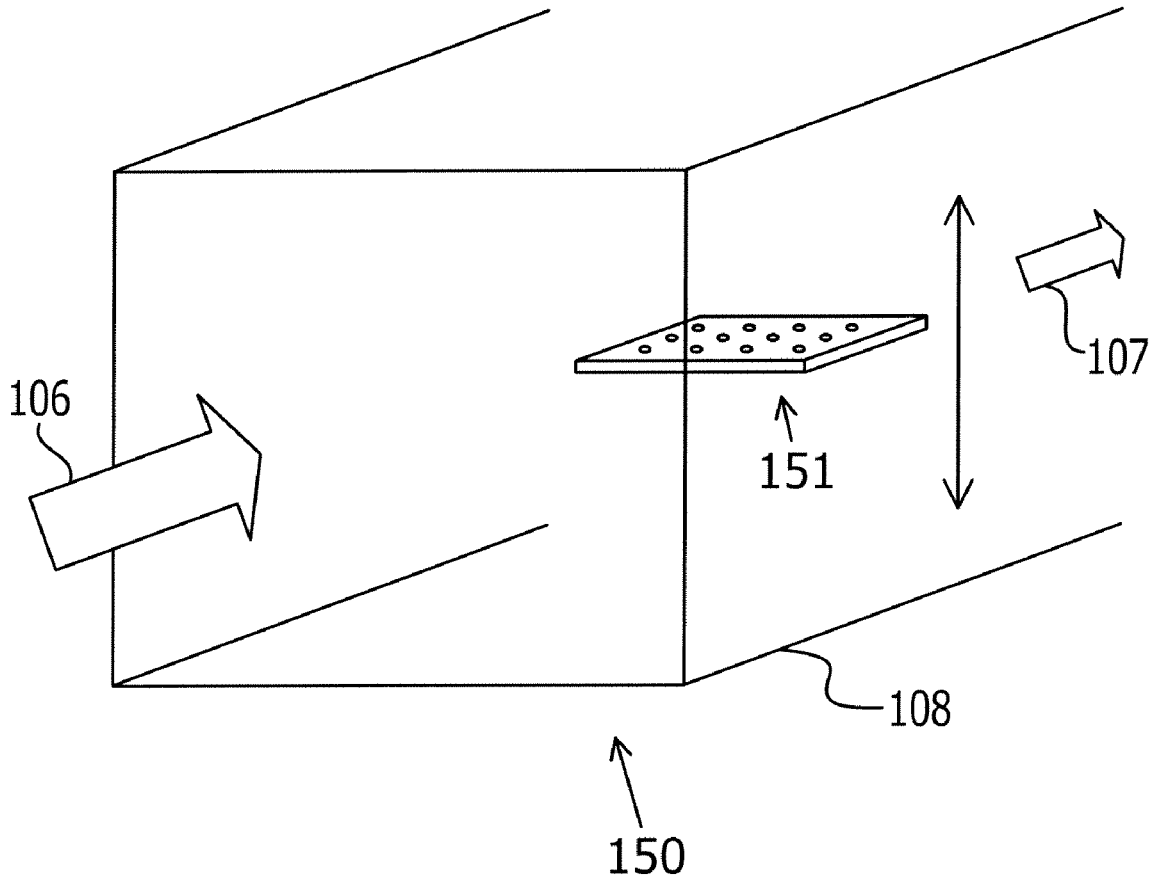
FIG. 13 is a schematic view of a muffling device according to a third embodiment.
Figure 14:
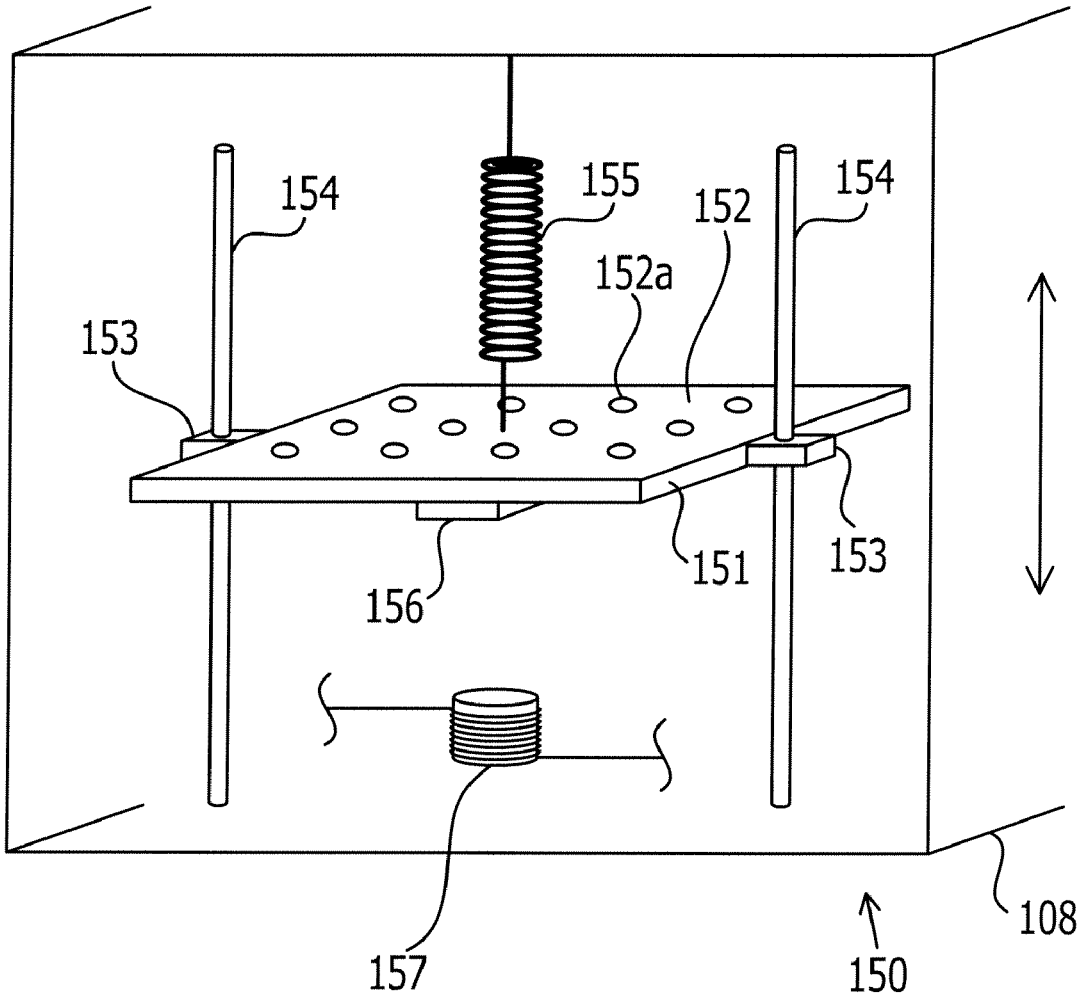
FIG. 14 is a schematic view of a drive unit that causes a muffling piece to move vertically.

FIG. 13 is a schematic view of a muffling device 150 according to a third embodiment. A muffling piece 151 illustrated in FIG. 13 is placed in a duct 108. The muffling piece 151 may move vertically in the duct 108. When the muffling piece 151 moves vertically in the duct 108, noise that has entered the duct 108 as illustrated by an arrow 106 is reduced and passes through the duct 108 as illustrated by an arrow 107 because of muffling performance of the muffling device 150. The vertical movement of the muffling piece 151 may obtain higher muffling performance than in a condition where the muffling piece 151 rests. FIG. 14 is a schematic view of a drive unit that causes a muffling piece 151 to move vertically. The specific configuration of the drive unit is described below.

The muffling device 150 includes the muffling piece 151. A top plate 152 of the muffling piece 151 includes two or more holes 152*a*. A surface of the top plate 152 may be the main surface that the sound to be muffled hits. Guide parts 153 are provided for both sides of the muffling piece 151. The muffling device 150 includes two guide rails 154 that are arranged in a standing manner in the duct 108. The guide rails 154 are inserted into the guide parts 153 respectively. A spring 155 that is locked on the ceiling of the duct 108 is attached to the top plate 152 of the muffling piece 151. A magnet 156 is attached to the bottom of the muffling piece 151. The muffling device 150 includes an electromagnet 157 that is placed on the floor of the duct 108. Another member that has magnetic properties may be employed instead of the magnet 156.

As described above, the muffling device 150 includes the guide parts 153, the guide rails 154, the spring 155, the magnet 156, and the electromagnet 157. The drive unit that moves the muffling piece 151 and is made up of these components may be an example. When a magnetic force is caused by providing electricity for the electromagnet 157, the muffling piece 151 attached with the magnet 156 is drawn toward the side of the electromagnet 157 and the spring 155 is expanded. After that, the provision of the electricity for the electromagnet 157 is stopped, so that the magnetic force is lost. As a result, the muffling piece 151 is drawn up along the guide rails 154 because of elasticity of the spring 155. Thus, the muffling device 151 may move vertically. The vertical movement of the muffling piece 151 may improve the muffling performance because the probability of the sound to be muffled hitting the muffling piece 151 is increased.

In the third embodiment, the example where the muffling piece 1 moves vertically is described. However the direction of movement may not be limited to the vertical direction. The direction of movement may be a horizontal direction or a diagonal direction, for example. A drive unit may also employ another power source such as a motor instead of a magnetic force. That is, generally, any publically known drive unit may be employed.

Figure 15A:
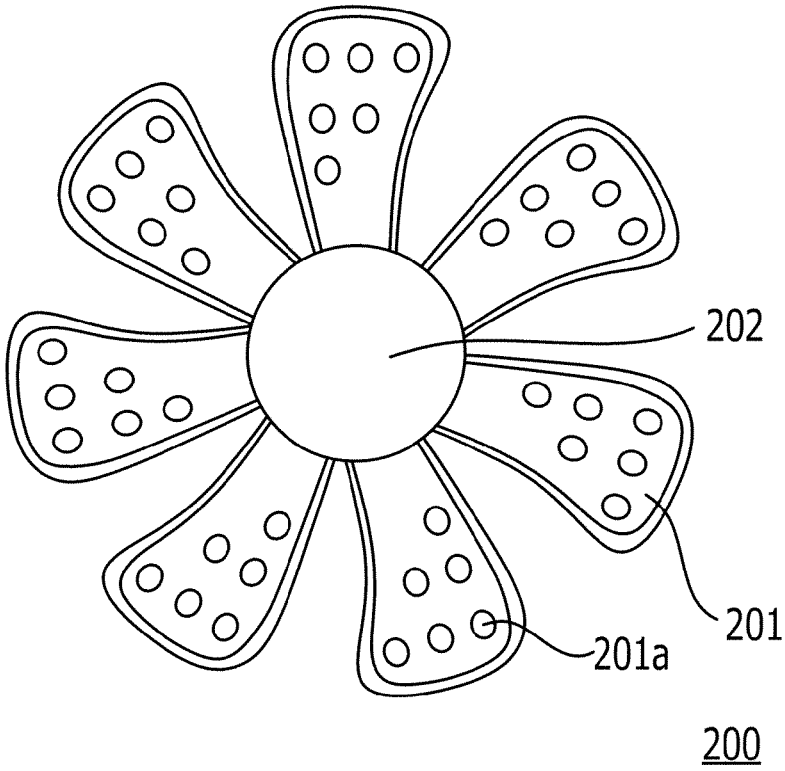
FIG. 15A is a top plan view of a muffling device according to a fourth embodiment.
Figure 15B:
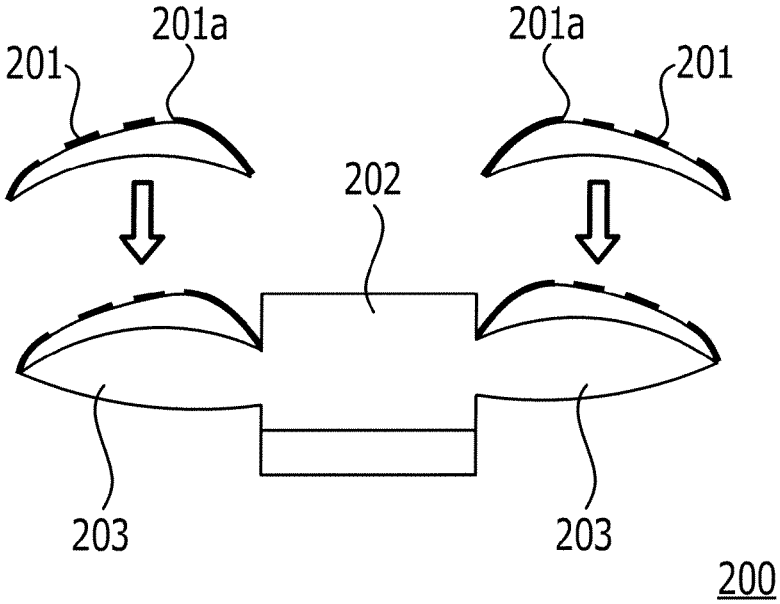
FIG. 15B is a side view of the muffling device according to the fourth embodiment.

FIG. 15A is a top plan view of a muffling device 200 according to a fourth embodiment and FIG. 15B is a side view of the muffling device 200 according to the fourth embodiment.

The muffling device 200 includes a muffling piece 201 illustrated in FIG. 15A and FIG. 15B. The muffling piece 201 includes two or more holes 201*a*. The muffling device 200 includes a fan 202. The muffling piece 201 is placed on a blade 203 of the fan 202 as illustrated in FIG. 15B. The muffling piece 201 may rotate together with the blade 203 of the fan 202. As a result, muffling performance may be improved. The muffling piece 201 may be placed on a rotor (not illustrated) that rotates the fan 202. The fan 202 may be an example of a drive unit.

Figure 16A:
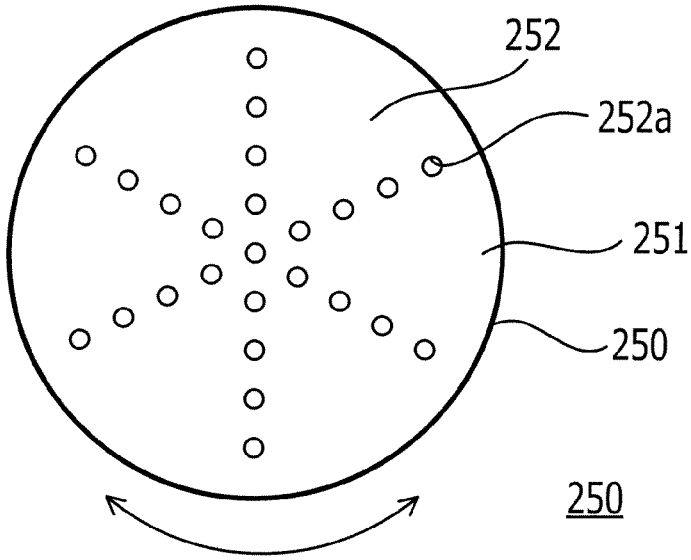
FIG. 16A is a top plan view of a muffling device according to a fifth embodiment.
Figure 16B:
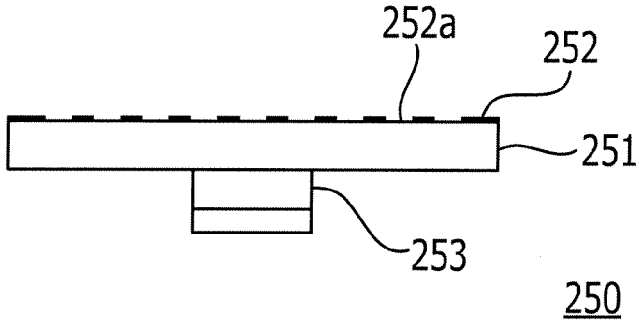
FIG. 16B is a side view of the muffling device according to the fifth embodiment.
Figure 16C:
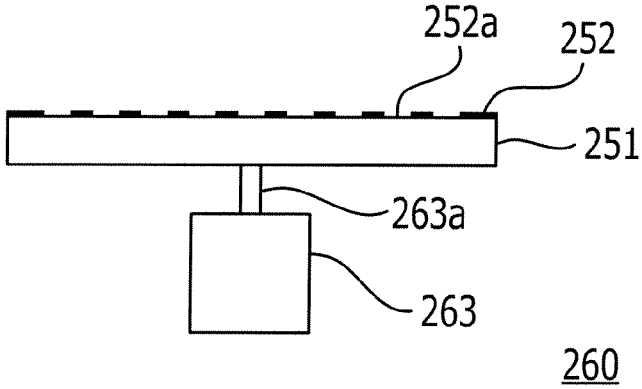
FIG. 16C is a side view of a muffling device according to a sixth embodiment.

FIG. 16A is a top plan view of a muffling device 250 according to a fifth embodiment and FIG. 16B is a side view of the muffling device 250 according to the fifth embodiment. FIG. 16C is a side view of a muffling device 260 according to a sixth embodiment.

The muffling device 250 illustrated in FIG. 16A and FIG. 16B includes a muffling piece 251. The muffling piece 251 includes a top plate 252 that includes two or more holes 252*a* and is placed on a rotor 253 that is rotatable. The surface of the top plate 252 is parallel to the rotation surface of the rotor 253. The surface of the top plate 252 may be the main surface that the sound to be muffled hits. The muffling piece 251 may be rotated by actuation of the rotor 253. The rotation of the muffling piece 251 may improve muffling performance because the probability of the sound to be muffled hitting the muffling piece 251 is increased. The muffling device 250 may be placed in a position where it is desired to muffle sound, such as an airflow path in a duct.

A muffling piece 251 may be rotated by attaching to a motor shaft 263*a* provided for a motor 263 as illustrated in a muffling device 260 in FIG. 16C. The rotor 253 and the motor 263 may be examples of a drive unit.

Figure 17A:
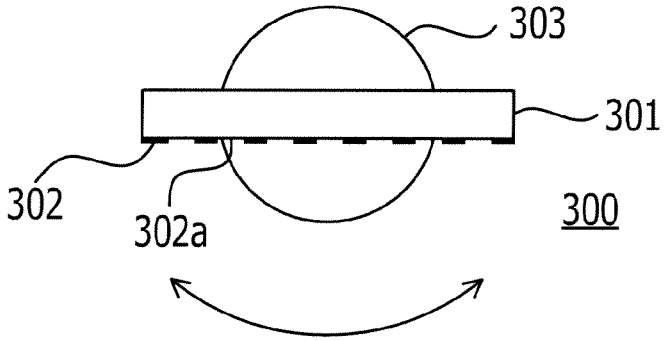
FIG. 17A is a top plan view of a muffling device according to a seventh embodiment.
Figure 17B:
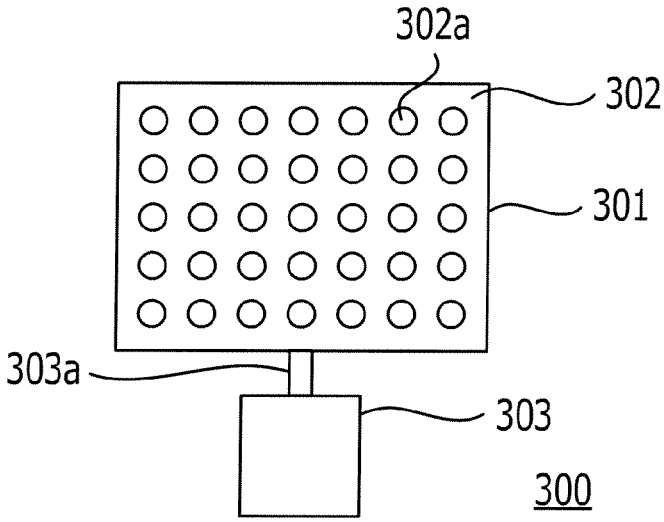
FIG. 17B is a front view of the muffling device according to the seventh embodiment.
Figure 17C:
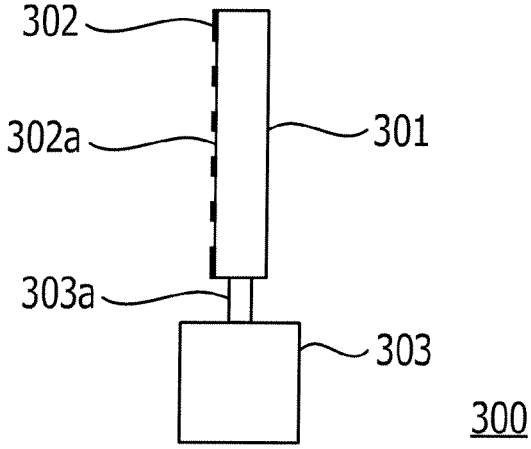
FIG. 17C is a side view of the muffling device according to the seventh embodiment.

FIG. 17A is a top plan view of a muffling device 300 according to a seventh embodiment and FIG. 17B is a front view of the muffling device according to the seventh embodiment, and FIG. 17C is a side view of the muffling device according to the seventh embodiment.

A muffling device 300 illustrated in FIG. 17A to FIG. 17C includes a muffling piece 301. A top plate 302 provided for the muffling piece 301 includes two or more holes 302*a*. The surface of the top plate 302 may be the main surface that the sound to be muffled hits. The muffling piece 301 is attached to a motor shaft 303*a* provided for a motor 303 so that the surface of the top plate 302 is substantially perpendicular to the top surface of the motor 303 as illustrated in FIG. 17B and FIG. 17C.

Thus, the muffling piece 301 rotates. The rotation of the muffling piece 301 may improve muffling performance because the probability of the sound to be muffled hitting the muffling piece 301 is increased. The muffling device 300 may be placed in a position where it is desired to muffle sound, such as an airflow path in a duct.

Figure 18:
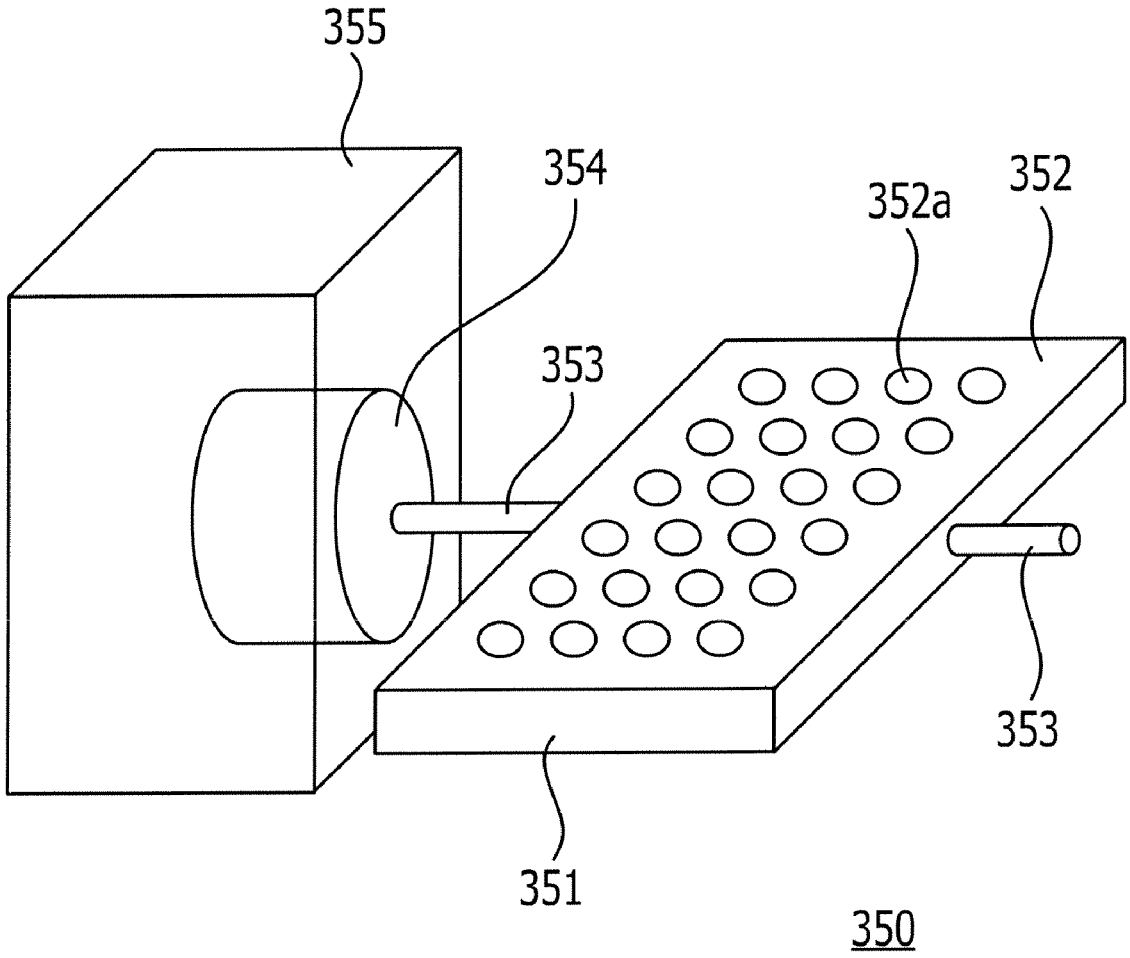
FIG. 18 is a schematic view of a muffling device according to an eighth embodiment.

A muffling device 350 according to an eighth embodiment is described below with reference to FIG. 18. The muffling device 350 illustrated in FIG. 18 includes a muffling piece 351. A top plate 352 provided for the muffling piece 351 includes two or more holes 352*a*. The muffling piece 351 includes a rotation shaft 353. A balancer 354 is attached to the end section of the rotation shaft 353. The balancer 354 is housed in a container 355. The rotation shaft 353 is inserted into grease. The muffling piece 351 supported by the grease may be rotated, for example, by swirling flow in a duct. The muffling device 350 may adjust the rotation speed of the muffling piece 351 by determining which grease is employed based on the property of the grease. A desirable muffling performance may be obtained by adjusting the rotation speed of the muffling piece 351. Both of the end sections of the rotation shaft 353 may be held by the grease. The muffling device 350 may be placed in a position where it is desired to muffle sound, such as an airflow path in a duct.

Figure 19:
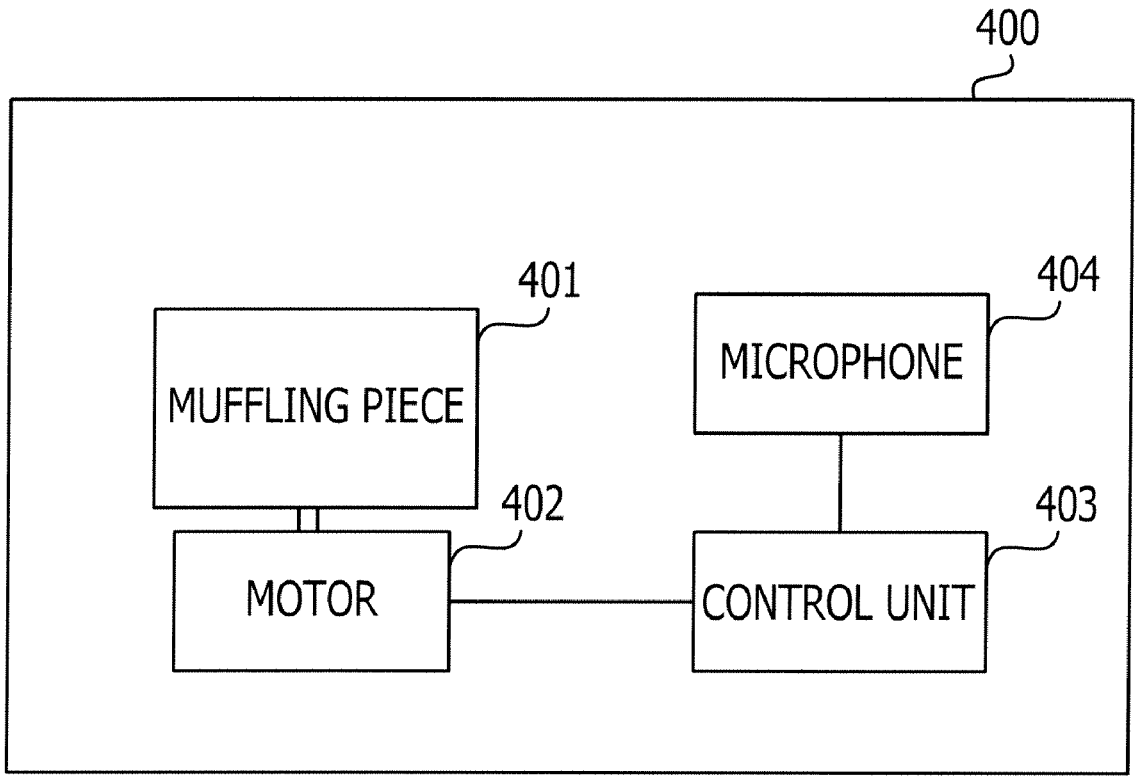
FIG. 19 is a block diagram of a muffling device provided with a control unit.

FIG. 19 is a block diagram of a muffling device 400 provided with a control unit 403. Control unit 403 can, among other things, control rotations of the muffling device. The muffling device 400 illustrated in FIG. 19 includes a muffling piece 401. The muffling piece 401 is attached to a motor 402 that is an example of a drive unit. The motor 402 is electrically coupled to the control unit 403. A microphone 404 is coupled to the control unit 403. The control unit 403 causes the motor 402 to change the rotation speed by giving instructions to the motor 402 based on a change in the measurement value of the microphone 404. Thus, the muffling performance may be improved. The muffling device 400 may improve the muffling performance by causing the control unit 403 to control the number of rotations of the muffling piece 401 as the muffling piece 401 rotates in the controlling operations in FIG. 19. However, when the muffling piece 401 moves vertically, horizontally, or diagonally, for example, the muffling device 400 may improve the muffling performance by causing the control unit 403 to change the movement speed of the muffling piece 401.

Figure 20:
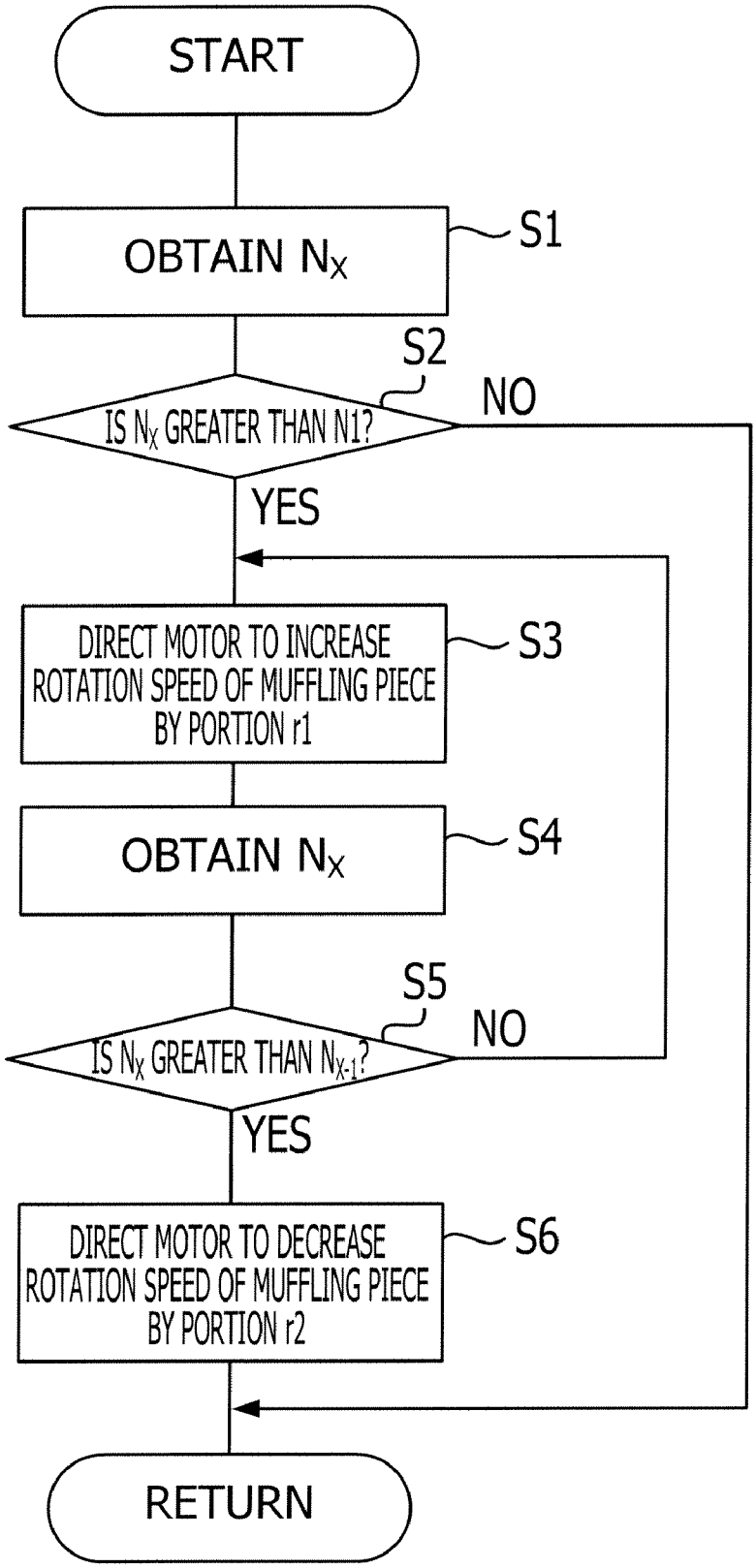
FIG. 20 is a flowchart of an example of controlling operations by the control unit in FIG. 19.

FIG. 20 is a flowchart of an example of the controlling operations executed by the control unit 403 illustrated in FIG. 19. The control unit 403 obtains a measurement value Nx through the microphone 404 in Operation S1. After that, the measurement value Nx is compared with a given threshold value N1 in Operation S2. When "No" is determined in Operation S2, that is to say the measurement value $N_X$ is smaller than the given threshold value N1, the current number of rotations of the motor 402 is maintained and the controlling operations are temporarily ended (RETURN).

On the other hand, when "Yes" is determined in Operation S2, that is to say the measurement value $N_X$ is greater than the given threshold value N1, the flow proceeds to Operation S3.

In Operation S3, the control unit 403 directs the motor 402 to increase the rotation speed of the muffling piece 401 by the portion r1.

In Operation S4 following Operation S3, the control unit 403 obtains a measurement value $N_X$ through the microphone 404 again. In Operation S5, the measurement value $N_X$ is compared with a measurement value $N_{X-1}$ that is obtained previously, that is, before the measurement value $N_X$ is obtained. When "No" is determined in Operation S5, that is to say the measurement $N_X$ is smaller than the measurement value $N_{X-1}$, the flow returns to Operation S3 again. After that, the controlling operations are repeated to further increase the rotation speed of the muffling piece 401 until "Yes" is determined in Operation S5, so that the muffling performance may be improved.

On the other hand, when "Yes" is determined in Operation S5, that is to say the measurement $N_X$ is greater than the measurement value $N_{X-1}$, the flow proceeds to Operation S6. In Operation S6, the control unit 403 directs the motor 402 to decrease the rotation speed of the muffling piece 401 by the portion r2. The value of r2 is smaller than the value of r1. When "Yes" is determined in Operation S5, the noise is undesirably enhanced by increasing the number of rotations of the muffling piece 401. In this case, the desired number of rotations of the muffling piece 401 may be controlled by decreasing the number of rotations of the muffling piece 401 so that noise reduction performance may be obtained.

A desired number of rotations for obtaining the muffling performance may be adjusted by performing the controlling operations described above.

The muffling device according to the first to eighth embodiments may desirably muffle the sound by the rotation and the movement of the muffling piece. The rotation and the movement of the muffling piece have little impact on the pressure loss. Thus, the muffling device that muffles sound by the rotation and movement of the muffling piece may be desirable for use in a duct, or the like. In addition, the rotation of the muffling piece may be desirable to muffle sound at a high frequency region as illustrated by the results of the muffling test in FIG. 7.

Figure 21A:
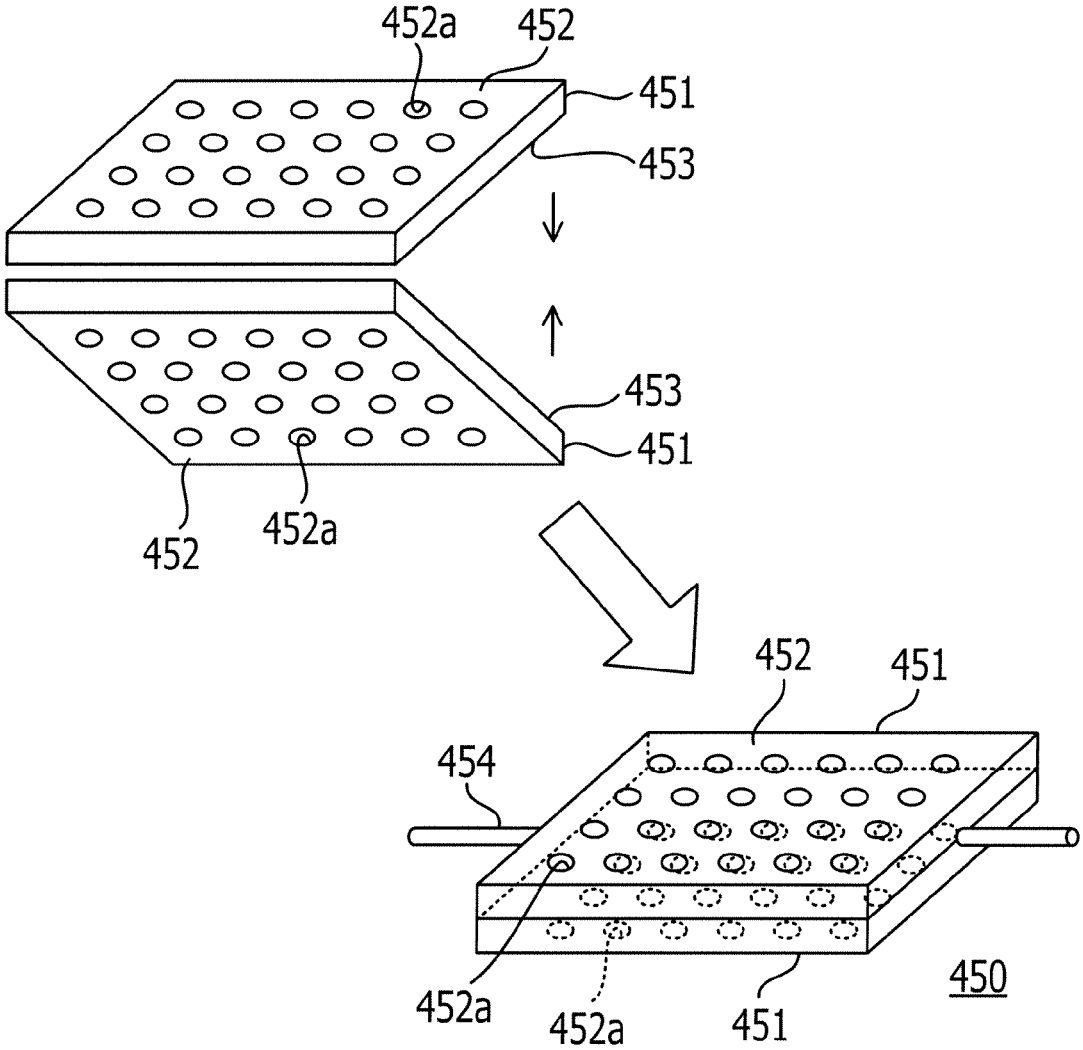
FIG. 21A and FIG. 21B are schematic views of a muffling device including two muffling pieces coupled to each other.
Figure 21B:
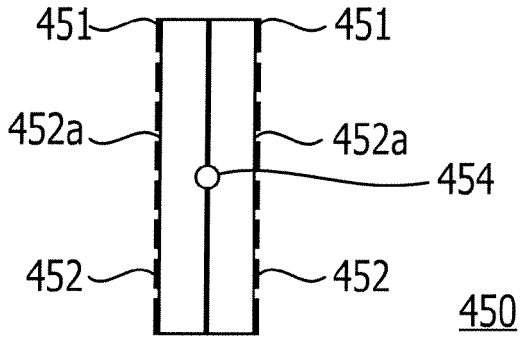

A muffling piece may employ various shapes and configurations. For example, a muffling device 450 illustrated in FIG. 21 includes two muffling pieces 451 provided with top plates 452 that includes two or more holes 452*a*. The two muffling pieces 451 are coupled to each other so that both bottom plates 453 are opposed to each other as illustrated in FIG. 21A and FIG. 21B. A rotation shaft 454 is attached to the muffling pieces 451 as illustrated in FIG. 21A and FIG. 21B. Thus, such a muffling device 450 includes the holes 452*a* on both the top and bottom surfaces. Instead of employing the coupled muffling pieces, for example, a box-shaped muffling piece may be divided into two sections by being arranged with a plate member in a hollow space of the box-shaped muffling piece and may include holes on both the top and bottom plates.

Figure 22:
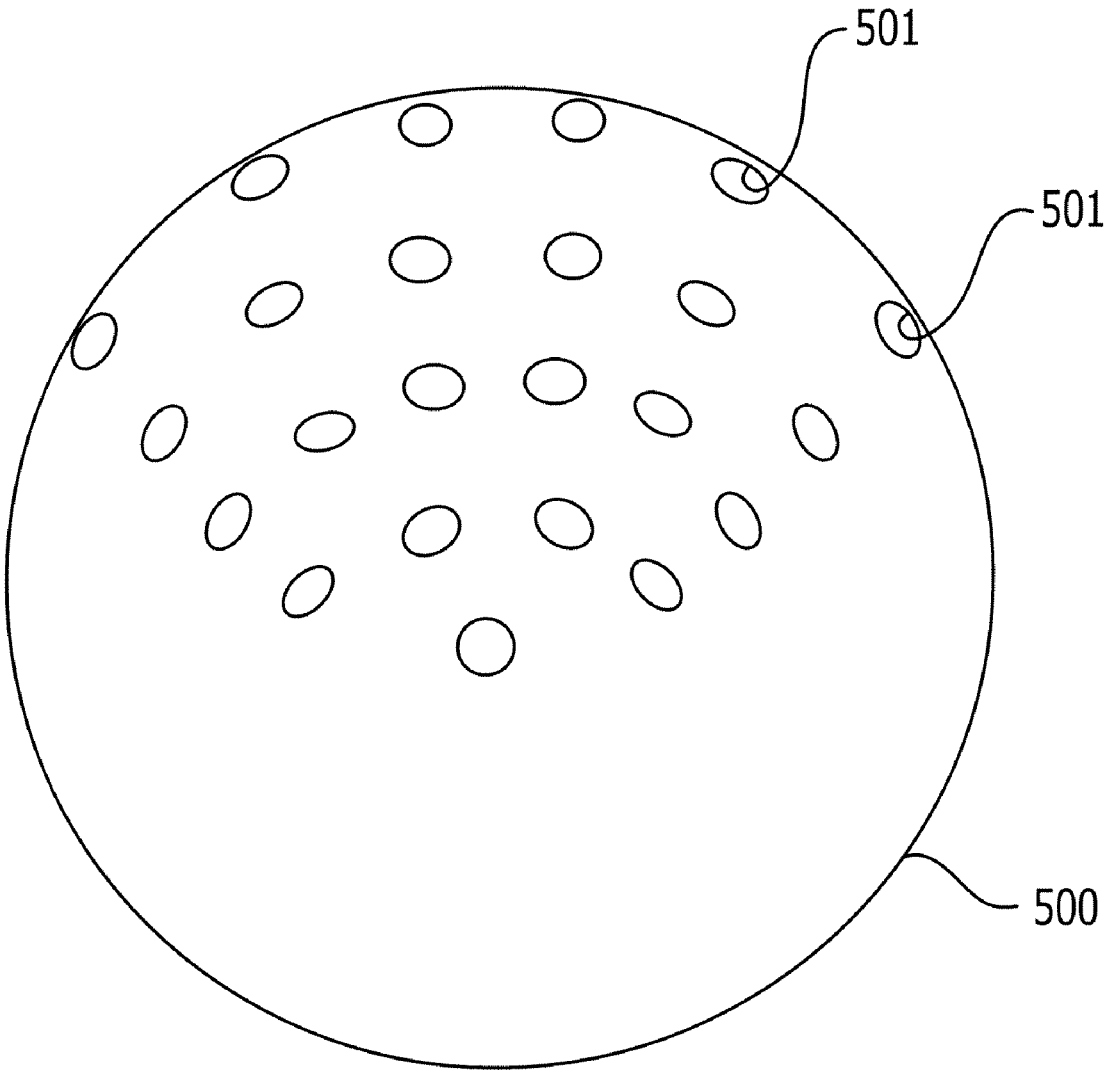
FIG. 22 is a schematic view of a spherically-shaped muffling device.

A muffling piece may be spherical-shaped as illustrated in FIG. 22. A spherical-shaped muffling piece 500 can include a hollow interior and two or more holes 501. The holes 501 may be distributed around the entire surface of the muffling piece 500 or unevenly distributed as illustrated in FIG. 22. The muffling piece 500 may be rotatably placed at a desired position through a shaft member (not illustrated) or without a shaft member.

Figure 23:
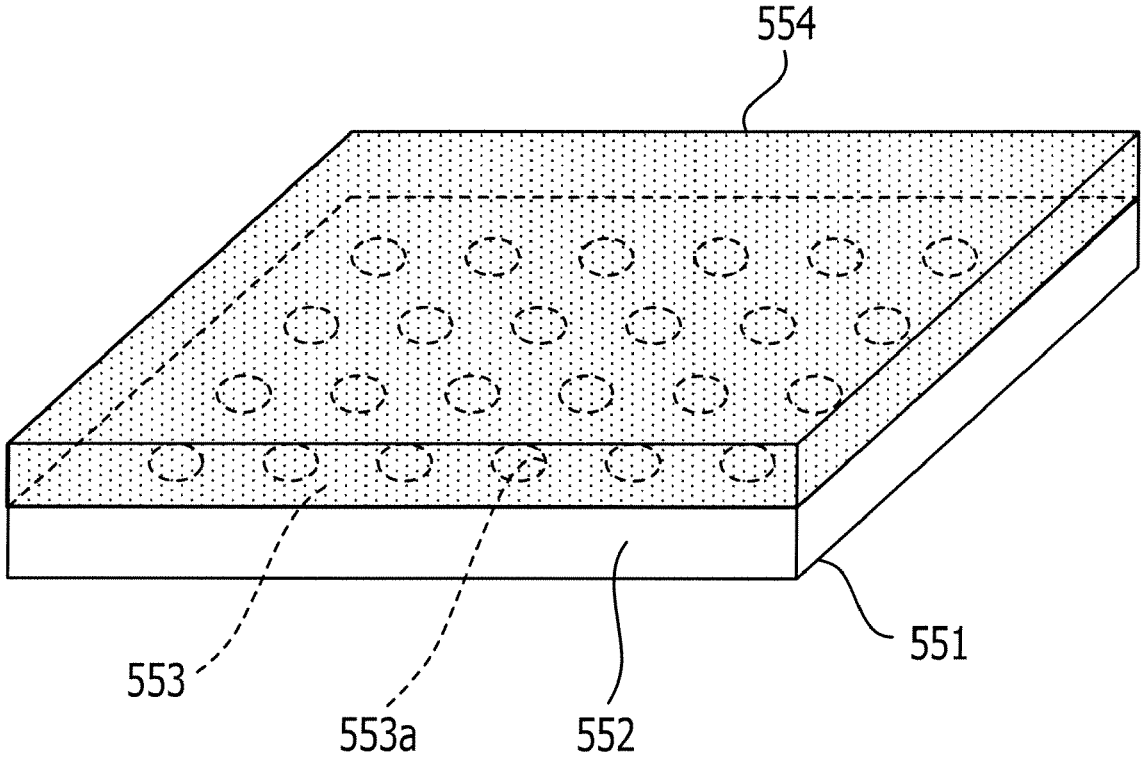
FIG. 23 is a schematic view of a muffling piece that is combined with a noise absorbing sponge.

In a muffling piece 551 illustrated in FIG. 23, a body section 552 of the muffling piece 551 is box-shaped. The body section 552 is provided with a top plate 553 that includes two or more holes 553*a* and combined with a noise absorbing sponge 554. The noise absorbing sponge 554 is attached to the top plate 553 to cover the holes 553*a* as illustrated in FIG. 23. Instead of the noise absorbing sponge 554, a nonwoven fabric, a film member, or the like may be attached to the top plate 553 to cover the holes 553*a*. The film member may employ, for example, a Polyethylene terephthalate (PET) film. The noise absorbing sponge 554, the nonwoven fabric, the film member, or the like that have windproof properties may be desirable. When the body section 552 is rotated without the noise absorbing sponge 554 or the like, it is probable that wind noise may occur at the holes 553*a* under certain conditions. The occurrence of the wind noise may be reduced by providing the noise absorbing sponge 554, the nonwoven fabric, the film member, or the like for the muffling piece 551.

Although the embodiments of the present invention are numbered with, for example, "first," "second," or "third," the ordinal numbers do not imply priorities of the embodiment. Many other variations and modifications will be apparent to those skilled in the art.

All examples and conditional language recited herein are intended for pedagogical purposes to aid the reader in understanding the aspects of the invention and the concepts contributed by the inventors to furthering the art, and are to be construed as being without limitation to such specifically recited examples and conditions, nor does the organization of such examples in the specification relate to a showing of the superiority and inferiority of the aspects of the invention. Although the embodiment in accordance with aspects of the present invention has been described in detail, it should be understood that various changes, substitutions, and alterations could be made hereto without departing from the spirit and scope of the invention.

Moreover, the term "or" is intended to mean an inclusive "or" rather than an exclusive "or". That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

What is claimed is:

1. A muffling device comprising:

a muffling piece that is configured to be placed in an airflow path and muffle sound caused by airflow; and a drive unit configured to perform rotation of the muffling piece around a rotation shaft extending in parallel with the airflow, wherein the muffling piece comprises:

a planar surface facing towards a direction perpendicular to the rotation shaft; and a plurality of apertures formed on the planner surface to expose an inner space of the muffling piece.

2. A muffling device comprising:

a muffling piece including a planar surface configured to encounter sound waves, caused by airflow, the surface of the muffling piece being rotatable around a rotation shaft extending in parallel with the airflow and the surface, wherein the planar surface faces towards a direction perpendicular to the rotation shaft and comprises a plurality of apertures thereon to expose an inner space of the muffling piece.

3. A noise-reduction device, comprising:

a noise reduction unit configured to be disposed in a path of sound waves caused by airflow; and a drive unit operatively coupled to said noise reduction unit, said drive unit configured to rotate the noise reduction unit around a rotating shaft extending in parallel with the airflow, wherein the noise reduction unit comprises:

a planar surface facing towards a direction perpendicular to the rotation shaft; and a plurality of apertures formed on the planner surface to expose an inner space of the noise reduction unit.

4. A noise reduction device according to claim 3, wherein said planar surface configured to encounter the sound waves, said planar surface being moveable relative to the sound waves.

5. A noise reduction device according to claim 3, wherein said noise reduction unit comprises a noise absorbing material.

6. A noise reduction device according to claim 3, wherein said noise reduction unit comprises a Helmholtz-type noise reduction unit.

7. The noise reduction device according to claim 1, wherein said the noise reduction unit is configured to be disposed in a ventilation duct in a building structure.

8. The noise reduction device according to claim 3, wherein the noise reduction unit is configured to be disposed in a ventilation duct in a building structure, wherein said ventilation duct carries air driven by a fan in an HVAC system.

9. The noise reduction device according to claim 3, wherein said drive unit comprises a drive motor including the rotation shaft.

* * * * *